US008259141B2

(12) United States Patent
Saitoh et al.

(10) Patent No.: US 8,259,141 B2
(45) Date of Patent: Sep. 4, 2012

(54) IMAGE FORMING DEVICE BASED ON DIRECT RECORDING METHOD AND IMAGE FORMING APPARATUS INCLUDING THE SAME

(75) Inventors: Masanori Saitoh, Tokyo (JP); Osamu Endou, Kanagawa (JP); Masanori Horike, Kanagawa (JP); Nobuaki Kondoh, Kanagawa (JP); Tomoko Takahashi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 404 days.

(21) Appl. No.: 12/650,090

(22) Filed: Dec. 30, 2009

(65) Prior Publication Data

US 2010/0183342 A1 Jul. 22, 2010

(30) Foreign Application Priority Data

Jan. 22, 2009 (JP) ..... 2009-012165

(51) Int. Cl.
*B41J 2/41* (2006.01)
*B41J 2/06* (2006.01)
*G03G 15/00* (2006.01)

(52) U.S. Cl. ..... 347/112; 347/55; 347/152

(58) Field of Classification Search ..... 347/55, 347/112, 152
See application file for complete search history.

(56) References Cited

U.S. PATENT DOCUMENTS 5,955,288 A 9/1999 Kirschner et al.
6,597,884 B2 7/2003 Miyaguchi et al.
6,708,014 B2 3/2004 Miyaguchi et al.
6,901,231 B1 5/2005 Sakai et al.
6,941,098 B2 9/2005 Miyaguchi et al.
6,947,691 B2 9/2005 Miyaguchi et al.
7,024,142 B2 4/2006 Sakai et al.
7,062,204 B2 6/2006 Miyaguchi et al.
7,123,864 B2 10/2006 Miyaguchi et al.
7,187,892 B2 3/2007 Horike et al.
7,200,352 B2 4/2007 Sakai et al.
7,236,720 B2 6/2007 Nakazato et al.
(Continued)

FOREIGN PATENT DOCUMENTS

JP 2910019 4/1999
(Continued)

OTHER PUBLICATIONS

U.S. Appl. No. 12/475,931, filed Jun. 1, 2009, Ichiro Kadota, et al.

*Primary Examiner* — Omar Rojas

(74) *Attorney, Agent, or Firm* — Oblon, Spivak, McClelland, Maier & Neustadt, L.L.P.

(57) ABSTRACT

An image creating apparatus includes a casing that stores therein an agent, an agent carrier rotatably supported by the casing, a hole defining member defining a plurality of holes therein and opposed to the agent carrier, a plurality of spray electrodes provided on the hole defining member respectively corresponding to the holes and forming an electric field for selectively causing the agent to be sprayed from the agent carrier towards the holes, and a positioning member provided on the casing to cover the agent carrier and positioning the hole defining member with respect to the agent carrier so that the agent carrier and the hole defining member are in a predetermined positional relationship. The angle of the positioning member is adjustable relative to the casing about a rotation shaft that is coaxial with the agent carrier.

12 Claims, 18 Drawing Sheets

U.S. PATENT DOCUMENTS

| | | | | |
|---|---|---|---|---|
| 7,308,222 | B2 | 12/2007 | Nakagawa et al. | |
| 7,526,238 | B2 | 4/2009 | Yamada et al. | |
| 2003/0001926 | A1* | 1/2003 | Itoh et al. | 347/55 |
| 2003/0011652 | A1* | 1/2003 | Itoh et al. | 347/14 |
| 2006/0251449 | A1 | 11/2006 | Takahashi et al. | |
| 2007/0013924 | A1 | 1/2007 | Sakai et al. | |
| 2007/0015071 | A1 | 1/2007 | Tsukamoto et al. | |
| 2007/0212121 | A1 | 9/2007 | Takahashi et al. | |
| 2007/0242985 | A1 | 10/2007 | Aoki et al. | |
| 2008/0089720 | A1 | 4/2008 | Tsukamoto et al. | |
| 2008/0089723 | A1 | 4/2008 | Tsukamoto et al. | |
| 2008/0286015 | A1 | 11/2008 | Kadota et al. | |
| 2009/0016781 | A1 | 1/2009 | Takahashi et al. | |
| 2009/0022523 | A1 | 1/2009 | Kadota et al. | |
| 2009/0035025 | A1 | 2/2009 | Ishii et al. | |
| 2009/0041492 | A1 | 2/2009 | Horike et al. | |
| 2009/0067879 | A1 | 3/2009 | Takahashi et al. | |
| 2009/0067889 | A1 | 3/2009 | Nakagawa et al. | |
| 2009/0074431 | A1 | 3/2009 | Aoki et al. | |
| 2009/0123193 | A1 | 5/2009 | Kosugi et al. | |
| 2009/0257786 | A1 | 10/2009 | Nakagawa et al. | |
| 2009/0257791 | A1 | 10/2009 | Nakagawa et al. | |
| 2009/0290901 | A1 | 11/2009 | Ishii et al. | |

FOREIGN PATENT DOCUMENTS

| | | | |
|---|---|---|---|
| WO | WO 01/32432 | A1 | 5/2001 |

* cited by examiner

IMAGE FORMING DEVICE BASED ON DIRECT RECORDING METHOD AND IMAGE FORMING APPARATUS INCLUDING THE SAME

CROSS-REFERENCE TO RELATED APPLICATIONS

The present application claims priority to and incorporates by reference the entire contents of Japanese Patent Application No. 2009-012165 filed in Japan on Jan. 22, 2009.

BACKGROUND OF THE INVENTION

1. Field of the Invention

The present invention relates to an image forming device for use in an image forming apparatus such as a printer, a facsimile, and a copier, and an image forming apparatus including the image forming device.

2. Description of the Related Art

As conventional image forming apparatuses, image forming apparatuses in which a direct recording type image forming method (hereinafter, referred to as direct recording type image forming apparatus) such as so-called toner-jet, direct toning, or toner projection is applied have been known (such as Japanese Patent Publication No. 2910019). In the image forming apparatuses of this type, unlike an electrophotographic process in which a latent image formed on a photosensitive body is developed by an image forming agent such as toner and the developed image is transferred from the photosensitive body onto a recording paper or a transfer medium, an image is directly formed on a recording paper, transfer medium, and the like, by depositing an image forming agent (toner) caused to be sprayed on the recording paper, the transfer medium, and the like.

FIG. 19 is a schematic of a key portion of a conventional direct recording type image forming apparatus. In FIG. 19, an agent carrier 501 is arranged so that the axis line is extended in the horizontal direction in FIG. 19, and while rotated and driven by a drive unit, which is not shown, the agent carrier 501 carries toner T that has been charged as an image forming agent on the surface. A flexible print circuit (FPC) 503 that is a hole defining member defining a plurality of holes 502 therein is arranged below the agent carrier 501. The FPC 503 includes a plurality of spray electrodes 504 in a ring shape formed on the surface opposite to the agent carrier 501, to surround each of the holes 502.

Below the FPC 503, a counter electrode 506 placed opposite to the agent carrier 501 with the FPC 503 interposed therebetween and a recording paper 507 placed on the counter electrode 506 and conveyed by a conveying unit are arranged. In FIG. 19, for descriptive purposes, only one each of the holes 502 and the spray electrodes 504 are shown. However, in practice, a plurality of combinations of the hole 502 and the spray electrode 504 is formed on the FPC 503. More specifically, for example, 4960 combinations are formed on the FPC 503 for 600 dots per inch (dpi).

The agent carrier 501 carries the toner T charged to a minus polarity on the surface, for example, while being grounded. When spraying voltage of plus polarity is applied to the spray electrodes 504, an electric field having a predetermined strength is applied to the toner T on the agent carrier 501 placed opposite to the spray electrodes 504, and the toner T placed near the toner T on the agent carrier 501 placed opposite to the spray electrodes 504. Due to the action of the electric field, the electrostatic force applied to the toner T exceeds the adhesive force between the toner T and the agent carrier 501. Accordingly, an aggregation of the toner T selectively caused to be sprayed from the agent carrier 501 in a dot shape, enters the holes 502. The toner T is caused to continuously be sprayed while being attracted to an electric field formed between the spray electrodes 504 and the counter electrode 506 charged to a potential higher than that of the spray electrodes 504. The toner T then passes through the holes 502, deposits on the surface of the recording paper 507, thereby forming a dot image.

The ON-OFF of the spraying voltage applied to each of the spray electrodes 504 is individually controlled by a dedicated integrated circuit (IC). In general, more chip area is required for IC, with an increase in the withstand voltage, thereby requiring a certain extent of installation space. Accordingly, the IC is fixed on an electrical substrate, which is not shown, integrally connected with the FPC 503, and the electric substrate is installed at a position a short distance away from the FPC 503.

To obtain high quality images in which the density and resolution of dot images is enhanced in the direct recording method, a toner supply gap that is an interval between the agent carrier 501 and the FPC 503 must be set and maintained with high accuracy.

In the image forming apparatus disclosed in Japanese Patent Publication No. 2910019, a positioning member that comes into contact with a hole defining member defining the holes therein and positions the hole defining member relative to the agent carrier, is fixed to both ends in the axial direction of the agent carrier. Because the positioning member positions the hole defining member relative to the agent carrier, a predetermined toner gap that is an interval between the agent carrier and the hole defining member can be set.

However, in the image forming apparatus disclosed in Japanese Patent Publication No. 2910019, the hole defining member only comes into contact with the positioning member at small portions of both ends in the axial direction of the agent carrier. The hole defining member is positioned under a so-called both ends supported state. Accordingly, a region near the center of the hole defining member in the axial direction of the agent carrier tends to bend and distort, by the weight of the hole defining member. Particularly, if the hole defining member is made of a flexible material such as a flexible print circuit, the bending and distortion near the center of the hole defining member in the axial direction of the agent carrier become significant. Due to such bending and distortion are produced on the hole defining member, problems such as the toner supply gap fluctuates in the axial direction of the agent carrier, and a predetermined toner supply gap cannot be maintained in the axial direction of the agent carrier occur.

The applicants of the present invention have proposed an image forming device that can solve the problems in Japanese Patent Application Laid-open No. 2008-273508 (hereinafter, referred to as prior application).

In other words, the image forming device of the prior application includes a casing that stores therein an agent, an agent carrier rotatably supported by the casing and facing outside through an opening formed on the casing, a sheet-like hole defining member that defines a plurality of holes therein, and placed opposite to the agent carrier with a predetermined interval therebetween, and a plurality of spray electrodes that is provided on the hole defining member in a manner corresponding to the holes, and forms an electric field for selectively causing the agent to be sprayed from the agent carrier towards the holes. The image forming device also includes a positioning member that is provided on the casing so as to cover the agent carrier, at least holds the hole defining member in the axial direction of the agent carrier by the side walls of the positioning member having an opening at a location opposite to a plurality of toner holes in the hole defining member, and positions the holes relative to the agent carrier so that the relative positions of the agent carrier and the holes are in a predetermined positional relationship.

In the image forming device of the prior application, the positioning member holds the hole defining member by the side walls in the axial direction of the agent carrier. Accordingly, compared to when the hole defining member is only held by the positioning member by both ends in the axial direction of the agent carrier, it is possible to prevent the hole defining member from bending, for example, causing the fluctuations in interval in the axial direction of the agent carrier. Consequently, it is possible to prevent the interval between the agent carrier and the hole defining member from fluctuating in the axial direction of the agent carrier, thereby maintaining a predetermined interval.

If the printing gap that is an interval between the holes formed on the hole defining member and the recording member fluctuates, the spraying time of the toner caused to be sprayed from the holes towards the recording member will not be uniform. Accordingly, the recording characteristics (image qualities) deteriorate significantly. The fluctuation of the printing gap is caused because, when the recording member passes through the location opposite to the hole defining member, the recording member moves in the thickness direction of the recording member while being displaced, due to vibration and the like.

For example, WO01/032432 discloses an image forming apparatus in which an image forming device is so arranged that, to maintain a predetermined printing gap, an intermediate transfer belt (i.e., a recording member) is brought into contact with a counter electrode including an abutting unit with which the intermediate transfer belt is wound and brought into contact, and part of the intermediate transfer belt that is wound around and brought into contact with the counter electrode and a plurality of holes of the hole defining member are opposed to each other.

Because the intermediate transfer belt is wound around and brought into contact with the counter electrode, the intermediate transfer belt and the counter electrode are brought into contact with each other without fail. Accordingly, it is possible to prevent the intermediate transfer belt from displacing in the thickness direction thereof, thereby maintaining a predetermined printing gap that is an interval between the holes of the hole defining member and the intermediate transfer belt.

FIG. 20 is a schematic of a color image forming apparatus on which four image forming devices 120 having the same configuration that form toner images of different colors on an intermediate transfer belt 200 by causing toner to be sprayed from a plurality of holes formed on a hole defining member 104, are mounted.

In this image forming apparatus, as described above, the intermediate transfer belt 200 is wound around and brought into contact with counter electrodes 240 corresponding to the image forming devices 120. In general, the locations where the intermediate transfer belt 200 is wound around the counter electrodes 240 tend to deviate towards the upstream or downstream of the counter electrodes 240 in the moving direction of the intermediate transfer belt, and a degree of deviation often differs. Accordingly, if the four image forming devices 120 having the same configuration are so arranged in the image forming apparatus that part of the intermediate transfer belt 200 that is wound around and brought into contact with the counter electrode 240 is opposed to a plurality of holes of the hole defining members 104, the image forming devices 120 are arranged in the image forming apparatus having different orientations for each of the counter electrodes 240 as shown in FIG. 20. Accordingly, if the image forming devices 120 are arranged in different orientations, as evident in FIG. 20, the image forming devices 120 are spread in a fan shape about the intermediate transfer belt 200, thereby forming unnecessary space between the image forming devices. Accordingly, the size of the image forming apparatus main body is increased.

To arrange the image forming devices 120 in the same orientation in the image forming apparatus, the configuration of the image forming device 120 may be varied, by changing the positions of the holes formed on the hole defining member 104 by each image forming device 120, and the like. However, if each of the image forming devices is formed differently, members dedicated for each of the image forming devices are required, thereby increasing cost.

SUMMARY OF THE INVENTION

It is an object of the present invention to at least partially solve the problems in the conventional technology.

According to one aspect of the present invention, there is provided an image forming device including: a casing that stores therein an image forming agent; an agent carrier that is rotatably supported by the casing, faces outside of the casing through an opening that is formed on the casing, and carries the image forming agent stored in the casing; a hole defining member that is formed in a sheet and includes a row of a plurality of holes in an axial direction of the agent carrier, and is arranged opposite to the agent carrier with a predetermined interval therebetween; a plurality of spray electrodes provided on the hole defining member respectively corresponding to the holes, and forms an electric field for selectively causing the image forming agent to be sprayed from the agent carrier towards the holes; and a positioning member provided on the casing to cover the agent carrier, at least holds the hole defining member in the axial direction of the agent carrier by side walls of its own having a portion defining an opening at a location opposite to the row of holes in the hole defining member, and positions the hole defining member with respect to the agent carrier so that relative positions of the agent carrier and the hole defining member are in a predetermined positional relationship. The image forming device is used in an image forming apparatus that, based on image information, forms an image by depositing the image forming agent selectively caused to be sprayed from the agent carrier by forming a spraying electric field, and having passed through the holes, on a recording member arranged in the image forming apparatus opposite to the agent carrier with the hole defining member interposed therebetween, and wound around and brought into contact with a counter electrode for forming an electric field that attracts the image forming agent caused to be sprayed from the agent carrier. An angle of the positioning member is adjustable relative to the casing about a rotation shaft that is coaxial with the agent carrier.

Furthermore, according to another aspect of the present invention, there is provided an image forming apparatus including: an image forming unit that includes a casing that stores therein an image forming agent, an agent carrier that is rotatably supported by the casing, faces outside of the casing through an opening that is formed on the casing, and carries the image forming agent stored in the casing, a hole defining member that is formed in a sheet and includes a row of a plurality of holes in an axial direction of the agent carrier, and is arranged opposite to the agent carrier with a predetermined interval therebetween, a plurality of spray electrodes provided on the hole defining member respectively corresponding to the holes, and forms an electric field for selectively causing the image forming agent to be sprayed from the agent carrier towards the holes, and a positioning member provided on the casing to cover the agent carrier, at least holds the hole defining member in the axial direction of the agent carrier by side walls of its own having a portion defining an opening at a location opposite to the row of holes in the hole defining member, and positions the hole defining member with respect to the agent carrier so that relative positions of the agent carrier and the hole defining member are in a predetermined positional relationship; and a counter electrode that is arranged opposite to the agent carrier with the hole defining member interposed therebetween, and forms an electric field for attracting the image forming agent caused to be sprayed from the agent carrier. Based on image information, the image forming apparatus forms an image by deposing the image forming agent selectively caused to be sprayed from the agent carrier by forming a spraying electric field on a recording member, after moving the image forming agent towards the counter electrode through the holes. An angle of the positioning member is adjustable relative to the casing about a rotation shaft that is coaxial with the agent carrier.

In the present invention, a fixing angle of a positioning member that holds a hole defining member relative to a casing can be changed, about a rotation shaft that is coaxial with an agent carrier. Accordingly, even if the fixing angle of the positioning member relative to the casing is changed, the hole defining member moves in arc, about the shaft of the agent carrier. Consequently, it is possible to maintain the relative positions of the agent carrier and the hole defining member in a predetermined positional relationship.

When an image forming device according to the present invention is arranged in an image forming apparatus, the fixing angle of the positioning member that holds the hole defining member relative to the casing is changed, based on the location where the recording member is wound around and brought into contact with an electrode. Accordingly, part of the recording member that is wound around and brought into contact with the electrode and a plurality of holes formed on the hole defining member held by the positioning member can be placed opposite to each other. In other words, even if a plurality of image forming devices according to the present invention is arranged in the image forming apparatus in the same orientation, part of the recording member that is wound around and brought into contact with a counter electrode and the holes of the hole defining member can be placed opposite to each other in any of the image forming devices, by changing the fixing angle of the positioning member that holds the hole defining member relative to the casing for each of the image forming devices.

In this manner, such as the conventional image forming apparatus, compared to when a configuration in which the image forming devices are obliquely arranged in the image forming apparatus main body, so that the recording member and the holes of the hole defining member are placed opposite to each other is adopted, it is possible to prevent unnecessary space from being formed between the image forming devices, thereby preventing the size of image forming apparatus from increasing.

Part of the recording member placed that is wound around and brought into contact with the counter electrode and the holes of the hole defining member can be placed opposite to each other, by changing the fixing angle of the positioning member that holds the hole defining member relative to the casing. Accordingly, the image forming devices having the same configuration can be used. As a result, it is possible to prevent cost from increasing, because members dedicated for each of the image forming devices are not required. This is possible because the configuration of the image forming devices need not be varied, by changing the positions of the holes formed on the hole defining member for each of the image forming devices and the like.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments in which the present invention is applied to an image forming apparatus will be described. A direct recording method applied to the present invention will now be described.

Figure 2:
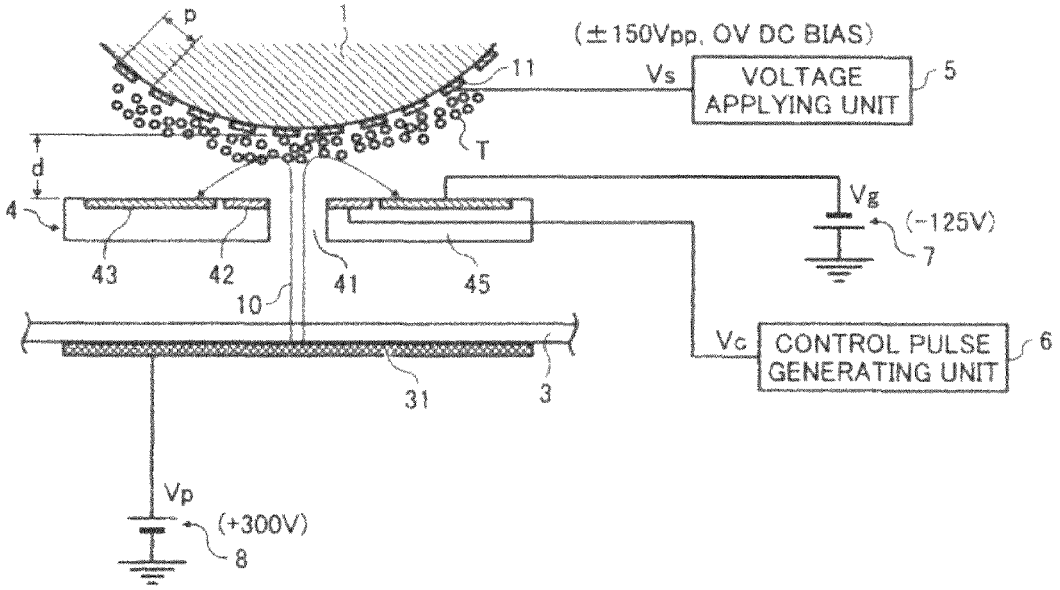
FIG. 2 is a schematic of a direct recording method.

FIG. 2 is a schematic of the direct recording method applied to the present invention.

This embodiment includes a roller-shaped toner carrier 1 that causes toner T to be sprayed and carries the toner T in a cloud-like state, a recording medium 3 to which the toner T is adhered, and a toner controlling unit 4 that includes a plurality of toner passage holes 41 arranged between the toner carrier 1 and the recording medium 3.

The toner carrier 1 includes a plurality of electrodes 11 arranged at a predetermined pitch, on the surface side, at a predetermined interval in the direction to which the toner T is conveyed (here, circumferential direction), and formed along the direction perpendicular to the direction to which the toner T is conveyed (here, axial direction). A pulse voltage (cloud pulse) having an average potential Vs in which the potential varies with time is applied to each of the electrodes 11 of the toner carrier 1, from a voltage applying unit 5 that is a power source. Accordingly, a unit that makes the toner T into a cloud is formed.

For example, a strong electric field is formed between the electrodes 11, because a pulse voltage with a frequency from 0.5 kilohertz to 7 kilohertz is applied, and because the intervals between the electrodes 11 are finely pitched. Accordingly, the toner T is caused to swiftly be sprayed from the surfaces of the electrodes 11 having the potential opposite to the charge polarity of the toner T, and the toner T caused to be sprayed is drawn to the electrodes 11 to which the potential with an attracting polarity is applied. The toner T is made into a cloud-like state, because the toner T is repeatedly caused to be sprayed in the vertical direction corresponding to the pulse frequency, due to the switching of the pulse.

In a region where the pulse frequency is high, the toner T caused to be sprayed high in the upward direction may be sprayed up again before returning to the surfaces of the electrodes 11, because the pulse is switched while the toner T is being sprayed.

The toner controlling unit 4 includes a row of the toner passage holes (opening) 41 through which the toner T passes, in the axial direction of the toner carrier 1. Control electrodes 42 in a ring shape are provided at the periphery of the toner passage holes 41, at the toner supplying side surface (surface of the toner carrier 1 side) of the toner controlling unit 4. Common electrodes 43 common to the toner passage holes 41 are provided on the outside of the control electrodes 42 from the toner passage holes 41 with an insulation region interposed therebetween.

Figure 3:
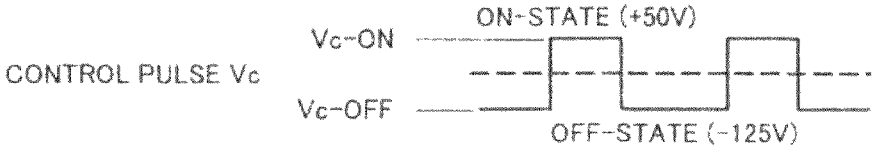
FIG. 3 is a schematic for explaining an example of a control pulse applied to a control electrode.

A control pulse Vc, for example, as shown in FIG. 3 is applied to the control electrodes 42, from a control pulse generating unit 6. A voltage Vc-on is applied to the control electrodes 42, to allow the toner T to pass though the toner passage holes 41 (ON state), and a voltage Vc-off is applied to the control electrodes 42, to prevent the toner T from passing through the toner passage holes 41 (OFF state). A voltage Vg is continuously applied to the common electrodes 43, from a power supplying unit 7. The control electrodes 42 of the toner controlling unit 4 may be operated only around the toner passage holes 41. The control electrodes 42 may be provided at the inner wall of the toner passage holes 41 or at both the inner wall of the toner passage holes 41 and at the periphery of the toner carrier 1 side.

At the recording medium 3, a rear electrode 31 is arranged at the rear side of the recording medium 3. The rear electrode 31 is an electrode unit that is a bias voltage applying unit to which a bias voltage for depositing the toner T that has passed through the toner controlling unit 4 on the recording medium 3 is applied. To deposit the toner T that has passed though the toner controlling unit 4 on the recording medium 3, a bias voltage Vp is applied to the rear electrode 31 from a bias power supplying unit 8. The recording medium 3 may be an intermediate transfer recording medium that forms an image on the recording medium once and then transfers the image on a paper, or a recording paper.

The bias voltage Vp may be applied to the recording medium 3, for example, by disposing the rear electrode 31 to the rear side (opposite surface side to the toner carrier 1) of the recording medium 3, and having the recording medium 3 pass through the upper surface of the rear electrode 31. If the intermediate transfer recording medium is used, an electrode may be buried therein (the electrode at the recording medium side is an inner electrode), or the rear electrode 31 may be disposed at the rear side of the intermediate transfer recording medium.

As described above, the toner carrier 1 and the toner controlling unit 4 are arranged as a unit to make the toner on the surface of the toner carrier 1 into a cloud. When the voltage Vs is applied to the electrodes 11 provided on the surface of the toner carrier 1, a voltage having a relationship in which the attracting direction and the repulsive direction of the toner T are alternately repeated is applied between the adjacent electrodes 11. The toner carrier 1 and the toner controlling unit 4 are arranged in a relationship, in which a distance d between the surface of the toner carrier 1 and the surface of the toner controlling unit 4 at the toner carrier 1 side (it means the surface at the side of the toner carrier 1) relative to a pitch p between the two-phase electrodes (or a pitch between n-phase electrodes that applies an n-phase voltage to the electrodes 11 at every n pieces), in other words, the toner supply gap, is increased ($p<d$).

This is because, in the relationship of p>d, a spraying electric field formed on the surfaces of the electrodes 11 of the toner carrier 1 interferes with the ON-OFF electric field formed on the surface of the toner carrier 1 side of the toner controlling unit 4, and a loop electric field of the toner controlling unit 4, which will be described later, is disturbed. Accordingly, the toner tends to deposit on the surface of the control electrodes 42. Under the condition of p<d, it is possible to prevent the toner from being deposited on the control electrodes 42 without fail, and even if dots are continuously printed, the density does not change, thereby obtaining a good image.

Figure 4A:
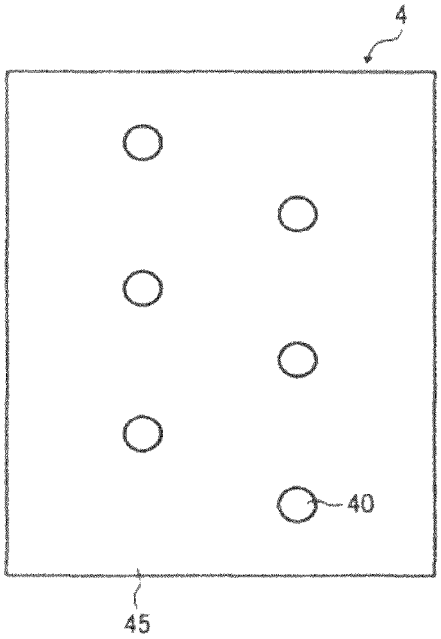
FIG. 4A is a schematic of the print surface side of a toner controlling unit.
Figure 4B:
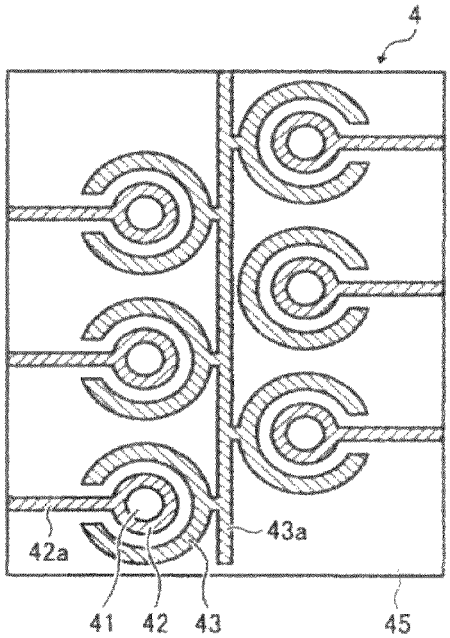
FIG. 4B is a schematic for explaining the toner supply side of the toner controlling unit.

An example of a specific configuration of the toner controlling unit 4 will now be described with reference to FIGS. 4A and 4B. FIG. 4A is a schematic for explaining the print surface side of the toner controlling unit 4, and FIG. 4B is a schematic for explaining the toner supply side of the toner controlling unit 4.

In the example, the control electrodes 42 in a ring shape having a width from 10 micrometers to 100 micrometers are provided on the surface at the toner supply side (the toner carrier 1 side) of an insulation substrate (base material) 45, so as to surround the toner passage holes 41. The common electrodes 43 that apply the common bias voltage Vg to the toner passage holes 41 are provided on the same surface as that of the control electrodes 42, at an interval of 20 micrometers to 50 micrometers from the control electrodes 42, in other words, with an insulation region formed by the insulation substrate 45 interposed therebetween.

In the example explained by using FIG. 2 and the like, the control electrodes 42 in a ring shape having a width from 10 micrometers to 100 micrometers are provided on the surface at the toner supplying side surface (toner carrier 1 side) of the insulation substrate (base material) 45, so as to surround the toner passage holes 41. The common electrodes 43 that apply the common bias voltage Vg to the toner passage holes 41 are provided on the same surface as that of the control electrodes 42, at an interval of 20 micrometers to 50 micrometers from the control electrodes 42, in other words, with an insulation region formed by the insulation substrate 45 interposed therebetween. At this time, the diameter of the toner passage holes 41 is determined by the size of dot diameter being formed, and is approximately from ϕ30 micrometers to ϕ150 micrometers.

Each of the control electrodes 42 is coupled with a lead pattern 42*a* connected to a driver circuit (drive circuit) that ON-OFF controls the passing of the toner T, and the common electrodes 43 are connected to a common lead pattern 43*a*. The print surface side of the insulation substrate 45 (surface at the recording medium 3 side) has the toner passage holes 41 being opened.

In this manner, each of the common electrodes 43 of the toner controlling unit 4 is formed so as to surround the outside of the control electrode 42 in a ring shape, with an insulation region interposed therebetween. Accordingly, the bias potential at the recording medium 3 side and the electric force formed between the common electrodes 43 on the outside of the control electrode 42 can be formed as an individual electric force line of each of the toner passage holes. Consequently, mutual interference (affected by the other toner passage holes 41) does not occur during multiple drive (drive in which toner is caused to be sprayed from a plurality of nozzle passage holes).

By forming the control electrodes 42 and the common electrodes 43 on the same surface of the toner controlling unit 4, the control electrodes 42 and the common electrodes 43 can be formed simultaneously by one manufacturing process, thereby accurately forming electrodes at a low cost.

Figure 5A:
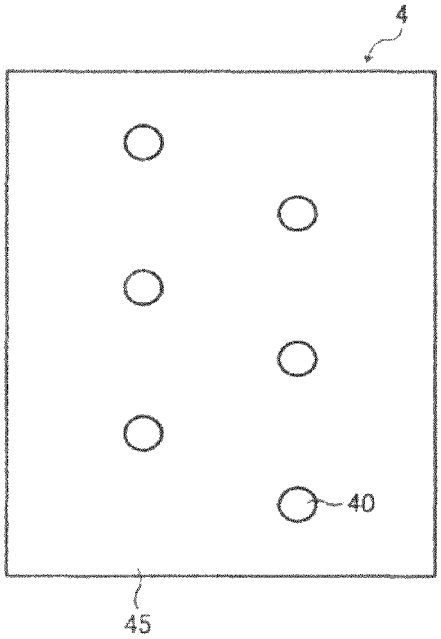
FIG. 5A is another schematic of the print surface side of the toner controlling unit.
Figure 5B:
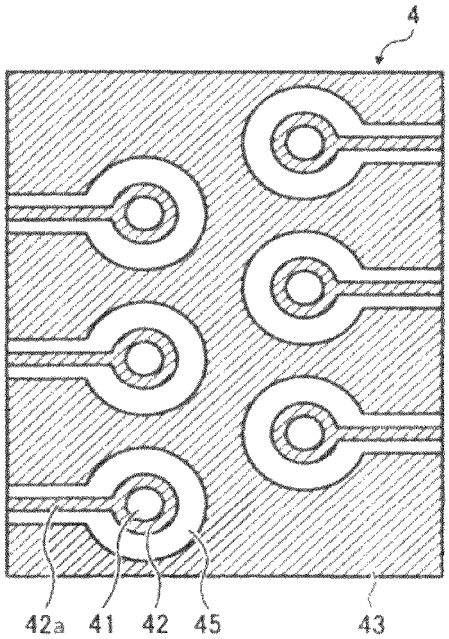
FIG. 5B is another schematic for explaining the toner supply side of the toner controlling unit.

Another example of a specific configuration of the toner controlling unit 4 will now be described with reference to FIGS. 5A and 5B. FIG. 5A is a schematic for explaining the print surface side of the toner controlling unit 4, and FIG. 5B is a schematic for explaining the toner supply side of the toner controlling unit 4.

In this example, the control electrodes 42 in a ring shape having a width from 10 micrometers to 100 micrometers are provided on the surface at the toner supply side (the toner carrier 1 side) of the insulation substrate (base material) 45, so as to surround the toner passage holes 41. The common electrode 43 that applies the common bias voltage Vg to the toner passage holes 41 is provided so as to cover the entire open space in a solid state, at an interval of an insulation region of 20 micrometers to 50 micrometers from each of the control electrodes 42.

In this manner, the common electrode 43 of the toner controlling unit 4 is formed in a solid state on the outside of the control electrodes 42 with an insulation region interposed therebetween. Because the common electrode 43 is formed over the entire region outside the control electrodes 42, an electric field of a bias potential at the recording medium 3 side can be shielded. Accordingly, it is possible to prevent the toner from being deposited on the control electrodes 42, thereby improving the toner usage efficiency.

In a specific manufacturing method of the toner controlling unit 4 such as this, a resin film such as polyimide, polyethylene terephthalate (PET), polyethylene naphthalate (PEN), and polyethersulfone (PES) having the thickness from 30 micrometers to 100 micrometers is used as the insulation substrate 45 that is an insulation material, from the cost and manufacturing process point of view. First, an aluminum (Al) vapor deposition film from 0.2 micrometer to 1 micrometer is formed on the film surface. After applying a photoresist on the film by a spinner using a photolithography process, prebake and mask exposure are performed. When the film is developed, the photoresist is heated and cured, and the Al is patterned by an Al etching solution. If an electrode pattern is also required on the rear surface of the film, the patterning may be performed as described above. However, a pattern used as a mask for forming holes may be formed on the rear surface of the film. Through holes that are the toner passage holes 41 can be accurately produced without positional deviation, by mechanical processing using a pressing tool after the pattern is formed, by excimer laser processing using the pattern formed on the rear surface, or by dry etching processing such as sputter etching processing.

In the direct recording type image forming apparatus formed as described above, the pulse voltage having an average potential Vs is applied to the electrodes 11 of the toner carrier 1. Accordingly, the toner T is caused to be sprayed above the toner carrier 1 and made into a cloud, and the toner T is conveyed by the rotation of the toner carrier 1 or by a traveling-wave electric field. A print bias voltage Vp is applied to the rear electrode 31 of the recording medium 3. In this state, the voltage Vg is applied to the common electrodes 43 of the toner controlling unit 4. To allow the toner T to pass through the toner passage holes 41 (ON state), the ON-state voltage Vc-on shown in FIG. 3 is applied to the control electrodes 42. To prevent the toner T from passing through the toner passage holes 41 (OFF state), the OFF-state voltage Vc-off shown in FIG. 3 is applied to the control electrodes 42.

In such an event, lines of electric force 10 in loops are formed between the recording medium 3 side and the common electrodes 43 of the toner controlling unit 4, while bypassing the control electrodes 42 that control the passing of the toner. This is enabled by setting the voltages applied to the electrodes 11, 31, 42, and 43 to certain values, and by enabling the toner T of the toner carrier 1 to pass through the toner controlling unit 4 toward the recording medium 3. Accordingly, the toner made into a cloud on the toner carrier 1 lands on the recording medium 3 via the electric field with the lines of electric force 10, through the toner passage holes 41 of the toner controlling unit 4. Consequently, a toner image can be directly formed on the recording medium 3, by ON-OFF controlling (open-close controlling) the toner passage holes 41 of the toner controlling unit 4, corresponding to the image.

The lines of electric force 10 are formed in loops between the recording medium 3 side and the common electrodes 43 of the toner controlling unit 4, while bypassing the control electrodes 42 that control the passing of the toner. Accordingly, the toner is prevented from depositing on the control electrodes 42 and at the periphery of the toner passage holes 41. Because the toner is made into a cloud, it is also possible to improve the toner usage efficiency.

Reference Example 1

A print unit and an image forming apparatus of the present reference example will now be described.

Figure 6:
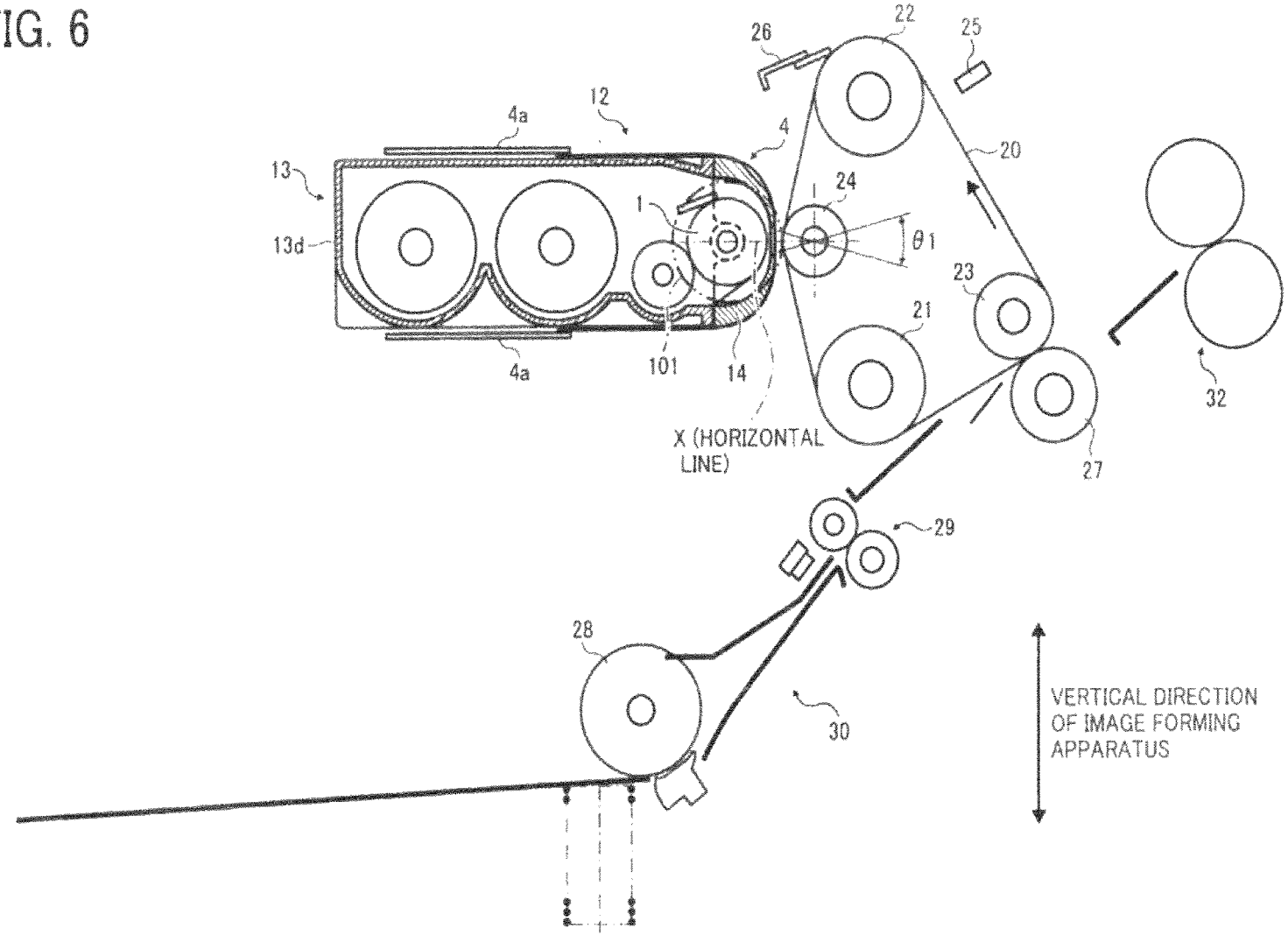
FIG. 6 is a side elevation view of an image forming apparatus on which the print unit is mounted.

FIG. 6 is a side elevation view of an image forming apparatus on which a print unit 12 is mounted. The print unit 12 mainly includes three elements of a developing unit 13 that supports the toner carrier 1, the toner controlling unit 4, and a holder 14 to which the toner controlling unit 4 is fixed, and they are integrally assembled. The three elements are detachably connected to each other, so that the print unit 12 can be assembled and dismantled with ease, and are integrally and detachably connected to the image forming apparatus as the print unit 12.

In the present reference example, to form and set a predetermined toner supply gap that is an interval between the toner carrier 1 and the toner controlling unit 4, the holder 14 that accurately determines relative positions of the toner carrier 1 and the toner controlling unit 4 is interposed between the developing unit 13 and the toner controlling unit 4.

Instead of using the holder 14, a method of directly fixing the toner controlling unit 4 on a case 13*d* of the developing unit 13, for example, by bending the toner controlling unit 4 so as to cover the toner carrier 1 may also be considered. However, the problems as described in the background section in this specification occur, and due to the low rigidity of the toner controlling unit 4 because of its flexibility, it is difficult to accurately set and maintain the toner supply gap over the entire region of the toner controlling unit 4.

Conventionally, a spacer is used to bring the toner controlling unit into contact with the toner carrier. However, because of problems such as toner scattering, a solution that can set and maintain the gap without bringing the spacer into contact with the toner carrier has been desired.

Accordingly, in the present reference example, the holder 14 that guides and holds the toner controlling unit 4, so that a desired surface shape can be obtained over the substantially entire region of the toner controlling unit 4, excluding a region where a number of toner passage holes 41 are opened on the toner controlling unit 4. By using the holder 14, substantially entire region of the toner controlling unit 4 excluding the region of the toner passage holes 41 is held by the side walls of the holder 14. Accordingly, the problems due to the low-rigidity of the toner controlling unit 4 as described above are solved, and the bending and distortion that cause the toner supply gap to fluctuate in the axial direction of the toner carrier in a region near the center of the toner controlling unit 4 in the axial direction of the toner carrier are eliminated. Consequently, it is possible to form and set a desired surface shape of the toner controlling unit 4 relative to the toner carrier 1, at a precise position.

In this image forming apparatus, a toner image is formed on an intermediate transfer belt 20 by the print unit 12, and the toner image is transferred onto a paper conveyed with the rotation of the intermediate transfer belt 20, eventually forming a toner image on the paper.

In an image forming unit, the intermediate transfer belt 20 is stretched by a drive roller 21, a tension roller 22, a transfer counter roller 23, a counter roller 24 that is an electrode (rear electrode) at the intermediate transfer belt 20 side used for controlling toner, and the like. In FIG. 6, the intermediate transfer belt 20 is rotated in the anti-clockwise direction by a motor, which is not shown, connected with the drive roller 21. The print unit 12 is arranged at the left side of the intermediate transfer belt 20 whose surface is stretched (the side opposite to the counter roller 24 with the intermediate transfer belt 20 interposed therebetween). A cleaning unit 26 shown in FIG. 6 cleans residual toner on the intermediate transfer belt 20.

The print unit 12 is transversely and horizontally arranged, and placed opposite to the counter roller 24 with the intermediate transfer belt 20 interposed therebetween. The toner controlling unit 4 of the print unit 12 is disposed apart from the intermediate transfer belt 20, as much as a predetermined interval (a few hundred micrometers), or a so-called printing gap. The position of the toner controlling unit 4 at this time is the printing position.

In the image forming unit shown in FIG. 6, a virtual straight line X that passes through the positions of the center of the rotation shaft of the toner carrier 1 and the center of the toner controlling unit 4 (rows of toner passage holes 41), passes through the center of the rotation shaft of the counter roller 24, and the virtual straight line X is also aligned with the horizontal line.

As described above, the toner controlling unit 4 forms the printing gap of a few hundred micrometers relative to the intermediate transfer belt 20, and the accuracy (acceptable gap range) is about a few ten micrometers. The inventors of the present invention, for example, if the printing gap is set to 300 micrometers, has positioned the toner controlling unit 4, so that at least the rows of toner passage holes 41 fall into the acceptable range of approximately ±30 micrometers, based on the position of 300 micrometers.

In the present reference example, rotatable rings 101 are disposed at both ends of the toner carrier 1 in the axial direction, to obtain the accuracy of the printing gap. By brining each of the rings 101 into contact with the counter roller 24, the printing gap between the toner controlling unit 4 integrally formed with the toner carrier 1 as the print unit 12, and the intermediate transfer belt 20 stretched by the counter roller 24 is formed and set at a predetermined interval within the acceptable gap range.

As shown in FIG. 6, the image forming apparatus also includes a transfer roller 27 that forms a transferring unit with the transfer counter roller 23 with the intermediate transfer belt 20 interposed therebetween, a mark sensor 25 that generates reference signals used for an image forming operation, located upstream in the rotational direction of the intermediate transfer belt than the tension roller 22, and downstream in the rotational direction of the intermediate transfer belt than the transfer counter roller 23, and the like.

Below the intermediate transfer belt 20, a sheet feeding and conveying unit 30 formed of a sheet feeding roller 28 and a pair of registration rollers 29 is arranged at the loading side of the transferring unit, so that the paper conveying direction is oblique to the transferring unit. A fixing device 32 is arranged at the unloading side of the transferring unit.

Figure 7A:
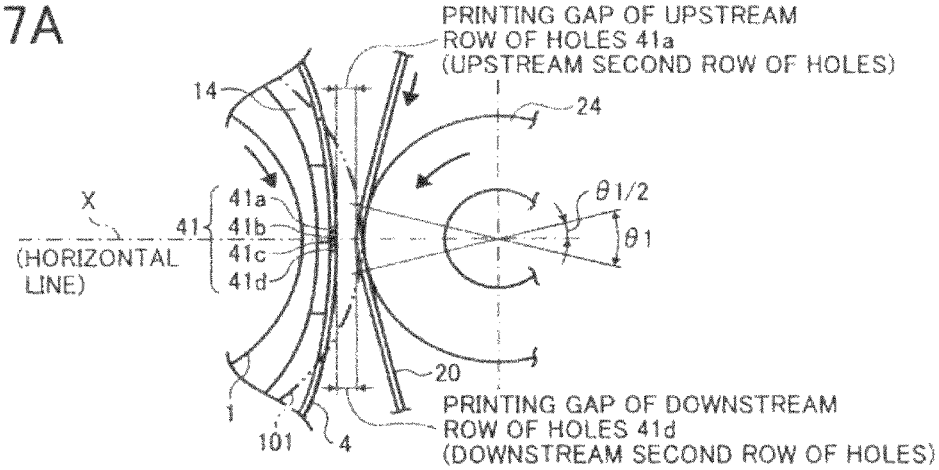
FIG. 7A is an enlarged view of a printing position.

Focusing on the printing position (FIG. 7A is an enlarged view), the intermediate transfer belt 20 should always come into contact with the counter roller 24 of the rear electrode at the printing position. Accordingly, the intermediate transfer belt 20 is wound around the counter roller 24 with a width to some extent (winding angle: θ1). The winding state of the intermediate transfer belt 20 is so that the bisector (center line) of the winding angle θ1 is aligned with the horizontal line.

In the present reference example, four rows of toner passage holes 41 (a row of holes 41*a*, a row of holes 41*b*, a row of holes 41*c*, and a row of holes 41*d*) of the toner controlling unit 4 are provided along the rotational direction of the toner carrier 1. As described above, the virtual straight line X that passes through the positions of the center of the rotation shaft of the toner carrier 1 and the center of the toner controlling unit 4, in other words, the intermediate position between the rows of holes 41*b* and 41*c* that is a median of the four rows of toner passage holes 41, passes through the center of the rotation shaft of the counter roller 24. The virtual straight line X is also aligned with the horizontal line.

Accordingly, in this configuration, the virtual straight line X and the bisector (center line) of the winding angle θ1 of the intermediate transfer belt 20 are matched, so that the virtual straight line X and the bisector (center line) of the winding angle θ1 are both aligned with the horizontal line. This is the most important point in the configuration shown in FIG. 7A, and this will now be described.

If the winding angle θ1 is divided into the upstream in the rotational direction and the downstream in the rotational direction of the counter roller 24, based on the virtual straight line X aligned with the horizontal line, as shown in FIG. 7A, the winding angle at the upstream in the rotational direction and the winding angle at the downstream in the rotational direction are equal to an angle of θ2 obtained by dividing the winding angle θ1 into two. Accordingly, the winding width of the intermediate transfer belt 20 wound around the counter roller 24 is the same in the upstream in the rotational direction and the downstream in the rotational direction. Consequently, the printing gap of the row of holes 41*a* located upstream in the rotational direction and the printing gap of the row of holes 41*d* located downstream in the rotational direction, at the opposing position with the intermediate transfer belt 20 are made the same. Similarly, the printing gap of the row of holes 41*b* located upstream in the rotational direction and the printing gap of the row of holes 41*c* located downstream in the rotational direction are made substantially the same. In other words, if the virtual straight line X is aligned with the bisector (center line) of the winding angle θ1, and when the orders of the rows of toner passage holes 41 in the upstream in the rotational direction and the downstream in the rotational direction counted based on the virtual straight line X are the same, the printing gaps between the rows of holes in the same order (the second row of holes 41*a* located upstream in the rotational direction and the second row of holes 41*d* located downstream in the rotational direction, and the first row of holes 41*b* located upstream in the rotational direction and the first row of holes 41*c* located downstream in the rotational direction) are made the same. In other words, to equalize the printing gaps of the rows of holes having the same order, in the upstream in the rotational direction and the downstream in the rotational direction, based on the virtual straight line X, the virtual straight line X needs to be aligned with the bisector (center line) of the winding angle θ1. Accordingly, if the virtual straight line X is aligned with the bisector, the intervals are made the same.

In FIGS. 6 and 7A, the intermediate transfer belt 20 is wound around the counter roller 24, so that the bisector (center line) of the winding angle θ1 is aligned with the horizontal line. To equalize the printing gaps of the same row order viewed from the virtual straight line X, between the upstream in the rotational direction and the downstream in the rotational direction, in the winding state, the virtual straight line X needs to be aligned with the horizontal line. Accordingly, in the configuration shown in FIG. 6, the print unit 12 is horizontally arranged. In other words, the orientation is inevitable.

However, the orientation of the print unit 12 is the result of limited state corresponding to the winding way of the intermediate transfer belt 20 as shown in FIGS. 6 and 7A, and is a special orientation only possible when the configuration conditions are met. In other words, the intermediate transfer belt 20 seldom wound around the counter roller 24 as the winding states as shown in FIGS. 6 and 7A, and in general, depending on the configuration of the image forming apparatus, the winding state is varied by the position and winding angle. Although this will be described later, if the winding state such as the winding position and angle of the intermediate transfer belt 20 varies, the printing gaps differ by each row of toner passage holes, unless the angle of the virtual straight line X is changed accordingly. In other words, if the virtual straight line X is not aligned with the bisector (center line) of the winding angle corresponding to the winding state of the intermediate transfer belt 20, the printing gaps of the same row order, in the upstream in the rotational direction and the downstream in the rotational direction, viewed from the virtual straight line X, will not be made the same.

Conventionally, the print unit 12 is obliquely mounted on the apparatus main body, so that the virtual straight line X is aligned with the bisector (center line) of the winding angle.

Figure 7B:
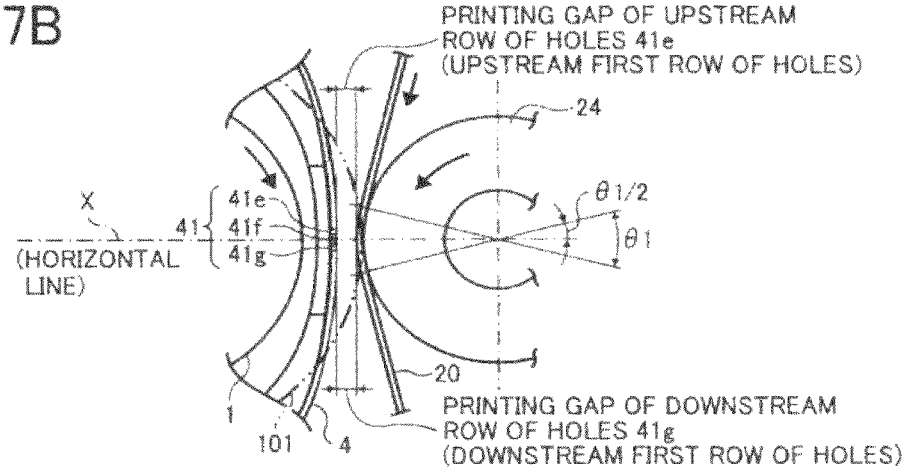
FIG. 7B is an enlarged view of a printing position, when three rows of holes are formed on the toner controlling unit.

FIG. 7B is a modification of the structure shown in FIG. 7A, and three rows of holes (a row of holes 41*e*, a row of holes 41*f*, and a row of holes 41*g*) are provided on the toner controlling unit 4. In this case, the row of holes 41*f* through which the virtual straight line X passes and positioned in the center of the three rows of holes is numbered as 0-th, and the printing gaps between the first row of holes 41*e* located upstream in the rotational direction and the first row of holes 41*g* located downstream in the rotational direction are made the same based on the virtual straight line X. In this manner, regardless of the number of rows of the toner passage holes 41, the virtual straight line X is aligned with the bisector (center line) of the winding angle, and the printing gaps of the same row order in the upstream in the rotational direction and the downstream in the rotational direction, viewed from the virtual straight line X, are made the same.

Figure 7C:
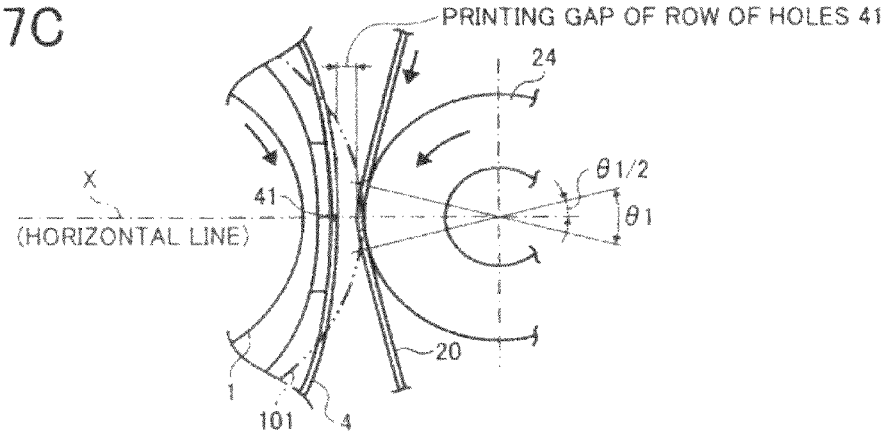
FIG. 7C is an enlarged view of a printing position, when one row of holes is formed on the toner controlling unit.

When a plurality of rows of toner passage holes 41 is provided in the rotational direction of the toner carrier 1, and if the rows of holes are even numbered, the "position in the center of the toner controlling unit 4 (rows of toner passage holes 41) through which the virtual straight line X passes" described above, is the center (median) of the rows of holes, and if the rows of holes are odd numbered, it is the row of holes positioned in the center among the rows of holes (the row of holes 41*f* in FIG. 7B). Needless to say, if only one row of holes is present, as shown in FIG. 7C, it is the row of toner passage holes 41.

The toner controlling unit 4 and the intermediate transfer belt 20 are both curved in opposite directions at the opposing position. Accordingly, the printing gaps of the same row order in the upstream in the rotational direction and the downstream in the rotational direction viewed from the virtual straight line X are made the same, and the center of the rows of toner passage holes 41 is closest to the intermediate transfer belt 20 (see FIGS. 7A to 7C). If this is constitutionally possible, the same is applicable when the toner controlling unit 4 and the intermediate transfer belt 20 curve in the same direction, or when either the toner controlling unit 4 or the intermediate transfer belt 20 is formed in a straight line. Exceptionally, in the event of concentric curvature, the printing gaps of all the rows of holes may be the same, even if the curving directions are the same. Theoretically, if the toner controlling unit 4 and the intermediate transfer belt 20 are curved in the relative directions from each other, the center of the rows of the toner passage holes 41 becomes the furthest. However, constitutionally, the toner controlling unit 4 and the intermediate transfer belt 20 will not be curved in the relative directions from each other.

The toner controlling unit 4 and the intermediate transfer belt 20 are curved in the opposite direction to each other with a certain curvature. Accordingly, with the rows of holes located at the same upstream in the rotational direction and located at the same downstream in the rotational direction, such as the rows of holes 41*a* and 41*b* located upstream in the rotational direction, and the rows of holes 41*c* and 41*d* located downstream in the rotational direction, if the row order viewed from the virtual straight line X is different, the printing gaps will naturally become different. The difference between the printing gaps such as this is increased, with the decrease of the curvature radius of the curves of the toner controlling unit 4, the intermediate transfer belt 20, and the like. On the contrary, if the curvature radiuses of the toner controlling unit 4, the intermediate transfer belt 20, and the like are increased, the gap difference can be reduced. Accordingly, it is possible to fit the printing gap within the acceptable range. Consequently, the curvature radiuses of the toner controlling unit 4 and the intermediate transfer belt 20 need to be set so that the printing gaps of all the rows of toner passage holes fall into the acceptable range without fail.

Figure 8A:
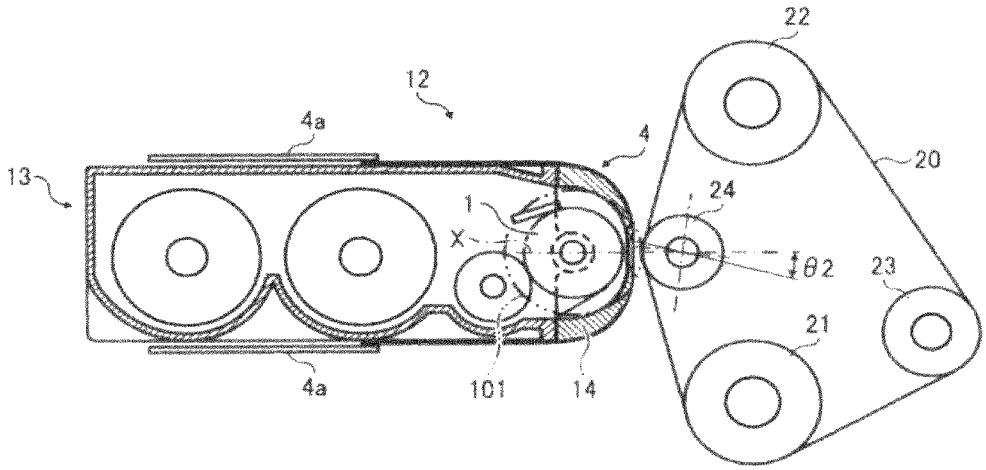
FIG. 8A is a side elevation view of an image forming apparatus on which the print unit is mounted, so that a virtual straight line is aligned with the center of a rotation shaft of a counter roller and with the horizontal line.

The configuration in FIG. 8A is substantially the same as that of FIG. 6. However, the winding state such as the winding position and angle of the intermediate transfer belt 20 relative to the counter roller 24 is different from that in FIG. 6.

In FIG. 8A, similar to FIG. 6, the print unit 12 is horizontally arranged to the apparatus main body, and the virtual straight line X that passes through the positions of the center of the rotation shaft of the toner carrier 1 and the center of the toner controlling unit 4 (the center position of the rows of toner passage holes 41) is aligned with the center of the rotation shaft of the counter roller 24. The virtual straight line X is also aligned with the horizontal line.

However, in FIG. 8A, the virtual straight line X is not aligned with the bisector (center line) of the winding angle. In FIG. 8A, the intermediate transfer belt 20 is wound around the counter roller 24, only at the upstream side in the rotational direction, and the intermediate transfer belt 20 is not wound around the counter roller 24 at the downstream in the rotational direction. Accordingly, if a winding angle of the intermediate transfer belt 20 relative to the counter roller 24 is set at $\theta 2$, and the winding angle $\eta 2$ is divided between the upstream in the rotational direction and the downstream in the rotational direction of the counter roller 24, based on the virtual straight line X aligned with the horizontal line, the winding angle at the upstream in the rotational direction is $\theta 2$ and the winding angle at the downstream in the rotational direction is zero.

Figure 8B:
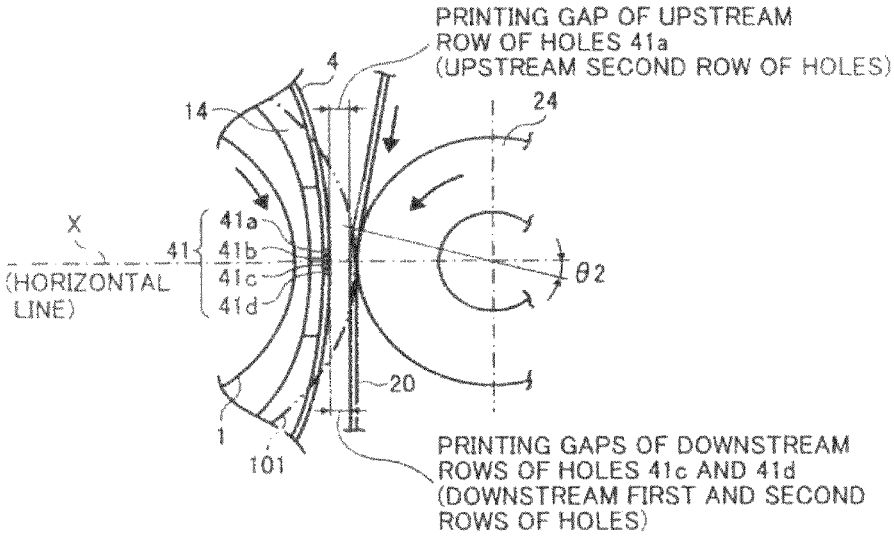
FIG. 8B is an enlarged view of a printing position of FIG. 8A.

FIG. 8B is an enlarged view of the printing position of FIG. 8A. In the winding state of the intermediate transfer belt 20 as described above, if the virtual straight line X passes through the center of the rotation shaft of the counter roller 24 and is aligned with the horizontal line, as apparent from FIG. 8B, a difference occurs between the printing gaps located upstream in the rotation direction and downstream in the rotation direction, viewed from the virtual straight line X. In other words, in the winding state as shown in FIG. 8B, the printing gap located upstream in the rotation direction is increased to be greater than that located downstream in the rotational direction. More specifically, if the printing gaps of the rows of holes in the same order are compared between the upstream in the rotational direction and the downstream in the rotational direction, viewed from the virtual straight line X, the printing gap of the row of holes 41*a* located upstream in the rotational direction is wider than that of the row of holes 41*d* located downstream in the rotational direction. Similarly, the printing gap of the row of holes 41*b* located upstream in the rotational direction is wider than that of the row of holes 41*c* located downstream in the rotational direction.

In general, the curvatures of the toner controlling unit 4, the intermediate transfer belt 20, and the like are set, so that the difference falls into the acceptable range of the printing gap, and the difference is very small from a few micrometers to a few ten micrometers. However, in the high definition image, this small difference deteriorates the image quality, in other words, is a cause for subtly fluctuating the dot density and dot diameter of the toner.

Figure 8C:
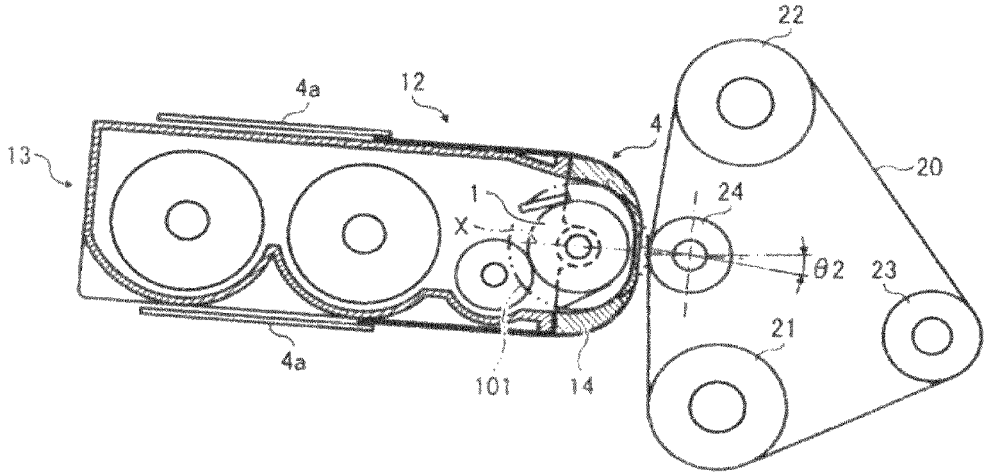
FIG. 8C is a side elevation view of an image forming apparatus, when the print unit is obliquely mounted on the apparatus main body.

To solve the problems, as shown in FIG. 8C, a method of obliquely mounting the print unit 12 on the apparatus main body, so that the toner controlling unit 4 (rows of toner passage holes 41) forms an optimal printing gap corresponding to the winding state of the intermediate transfer belt 20, is generally adopted. This is explained with reference to FIG. 8D and the like that is an enlarged view of the printing position of FIG. 8C.

In the configuration as shown in FIG. 8A, upon referring to the virtual straight line X aligned with the horizontal line, the intermediate transfer belt 20 is wound around the counter roller 24 only at the upstream in the rotational direction, at a width of the winding angle $\eta 2$. However, when the print unit 12 is obliquely mounted on the apparatus main body, and an angle is given between the virtual straight line X and the horizontal line, the intermediate transfer belt 20 can also be wound around the counter roller 24 at the downstream in the rotational direction.

Figure 8D:
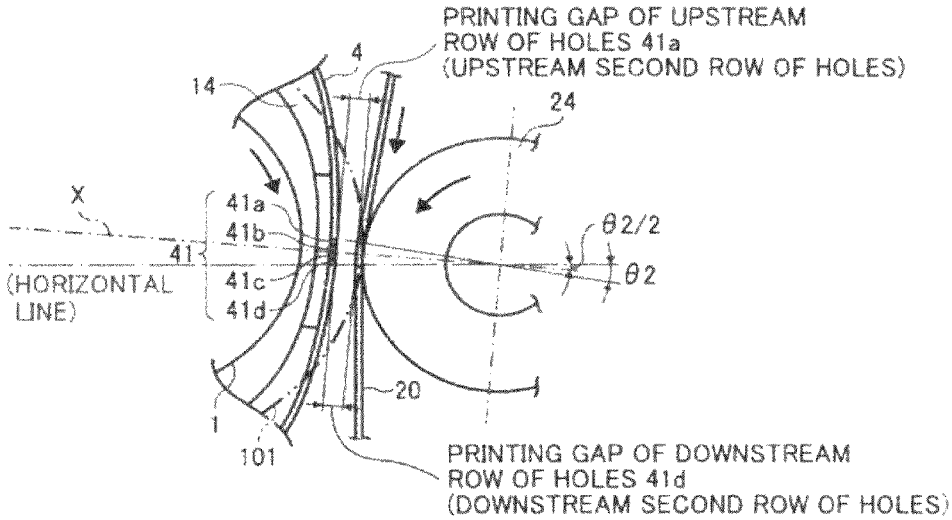
FIG. 8D is an enlarged view of a printing position of FIG. 8C.

As shown in FIG. 8D, with the print unit 12, the angles of the holder 14 and the toner controlling unit 4 (rows of toner passage holes 41), in other words, the angle of the virtual straight line X to the horizontal line, is tilted by an angle of $\theta 2/2$ obtained by dividing the winding angle $\eta 2$ at the upstream in the rotational direction into two about the counter roller 24, and the virtual straight line X is aligned with the bisector (center line) of the winding angle $\eta 2$. Accordingly, when the winding angle $\eta 2$ is divided between the upstream in the rotational direction and the downstream in the rotational direction of the counter roller 24, based on the tilted virtual straight line X, the winding angle at the upstream in the rotational direction and the winding angle at the downstream in the rotational direction are equal to the angle of $\theta 2/2$. The winding width of the intermediate transfer belt 20 to the counter roller 24 is also made the same in the upstream in the rotational direction and the downstream in the rotational direction. If the virtual straight line X is aligned with the bisector (center line) of the winding angle $\eta 2$, the printing gaps of the rows of toner passage holes 41 in the same order in the upstream in the rotational direction and the downstream in the rotational direction are made the same. Accordingly, the same situation as that in FIG. 7A can be made. More specifically, the printing gaps between the second row of holes 41*a* located upstream in the rotational direction and the second row of holes 41*d* located downstream in the rotational direction viewed from the virtual straight line X, and the first row of holes 41*b* located upstream in the rotational direction and the first row of holes 41*c* located downstream in the rotational direction viewed from the virtual straight line X are made the same.

In this manner, when the print unit 12 is tilted corresponding to the winding state of the intermediate transfer belt 20, and a predetermined printing gap is formed and set, a good image can be formed. However, because the print unit 12 is tilted, the side effects such as an increase in the size of image forming apparatus (an extra space is required to arrange the print unit 12 due to the orientation), and complex layouts occur.

Figure 9A:
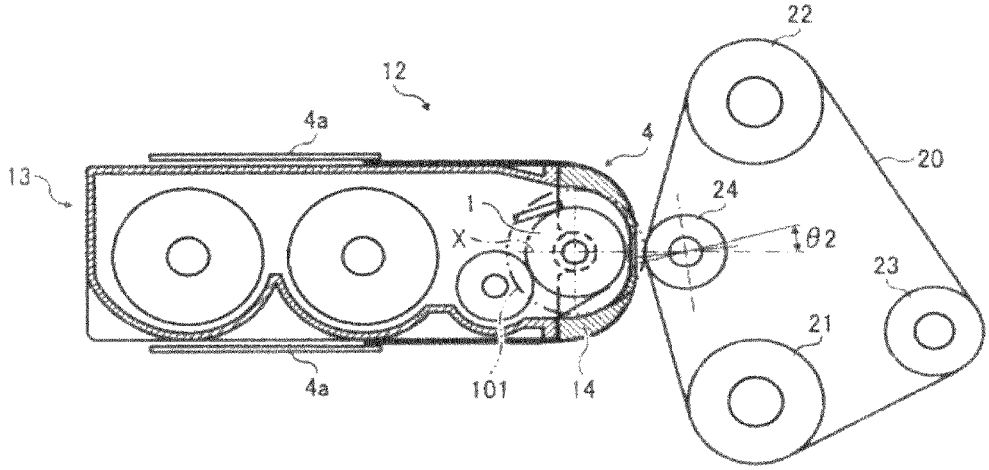
FIG. 9A is a side elevation view of an image forming apparatus when a region of the printing position in FIG. 8A is horizontally symmetrical.
Figure 9B:
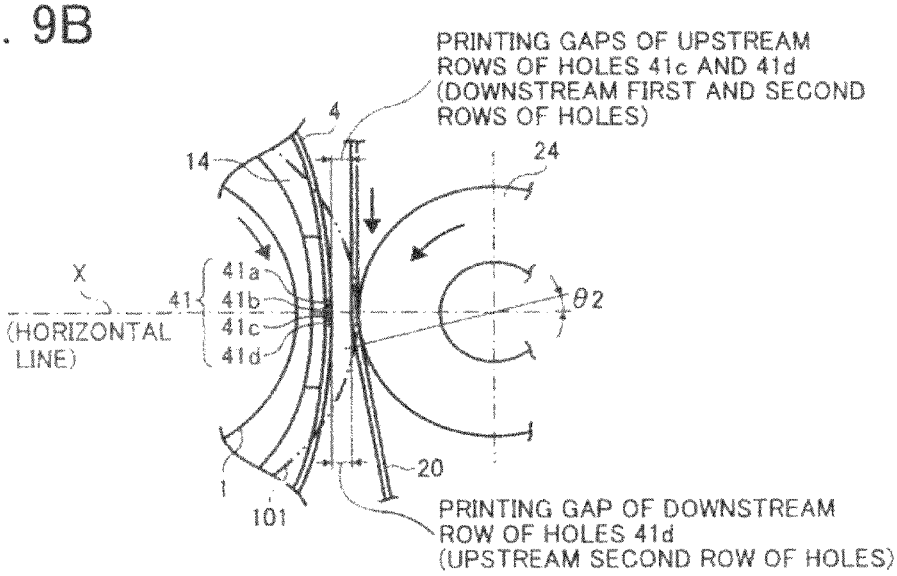
FIG. 9B is a side elevation view of the image forming apparatus, when a region of the printing position in FIG. 8B is horizontally symmetrical.
Figure 9C:
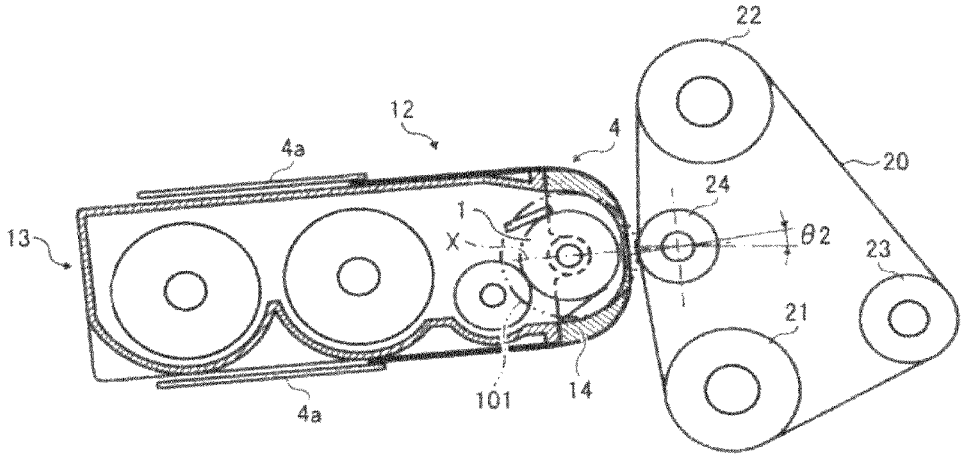
FIG. 9C is a side elevation view of the image forming apparatus when the print unit is obliquely mounted on the apparatus main body.
Figure 9D:
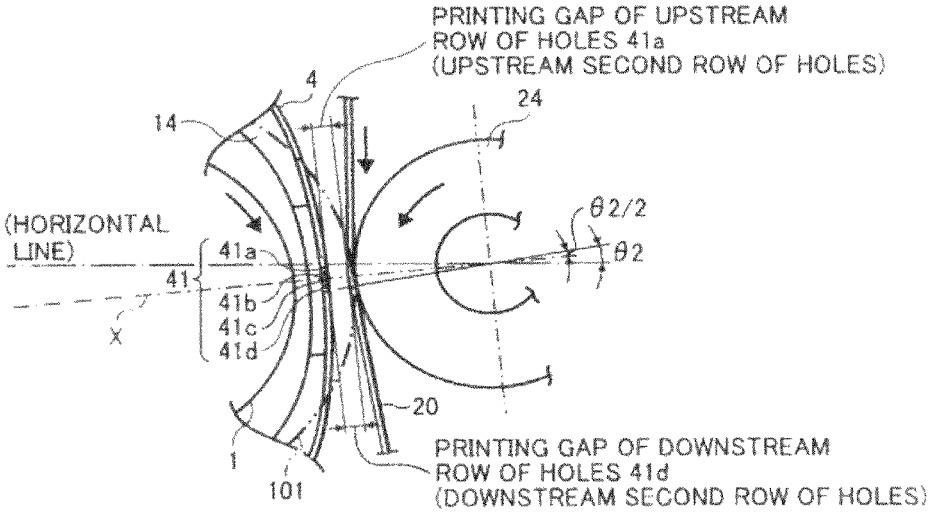
FIG. 9D is an enlarged view of a printing position of FIG. 9C.

FIGS. 9A and 9B are schematics in which the regions around the printing positions in FIGS. 8A and 8B are horizontally symmetrical. Here, the intermediate transfer belt 20 is wound around the counter roller 24 only at the downstream in the rotational direction, and is not wound around the counter roller 24 at the upstream in the rotational direction. In this case, as shown in FIG. 9B, a difference occurs between the printing gap located upstream in the rotational direction and the printing gap located downstream in the rotational direction viewed from the virtual straight line X. In other words, the printing gap located downstream in the rotational direction is wider than that located upstream in the rotational direction. Because FIGS. 9C and 9D are the same as FIGS. 8C and 8D, except that the angle to which the print unit 12 is tilted is reversed as shown in FIGS. 9C and 9D, the descriptions of problems and solutions in this configuration will be omitted.

Figure 10:
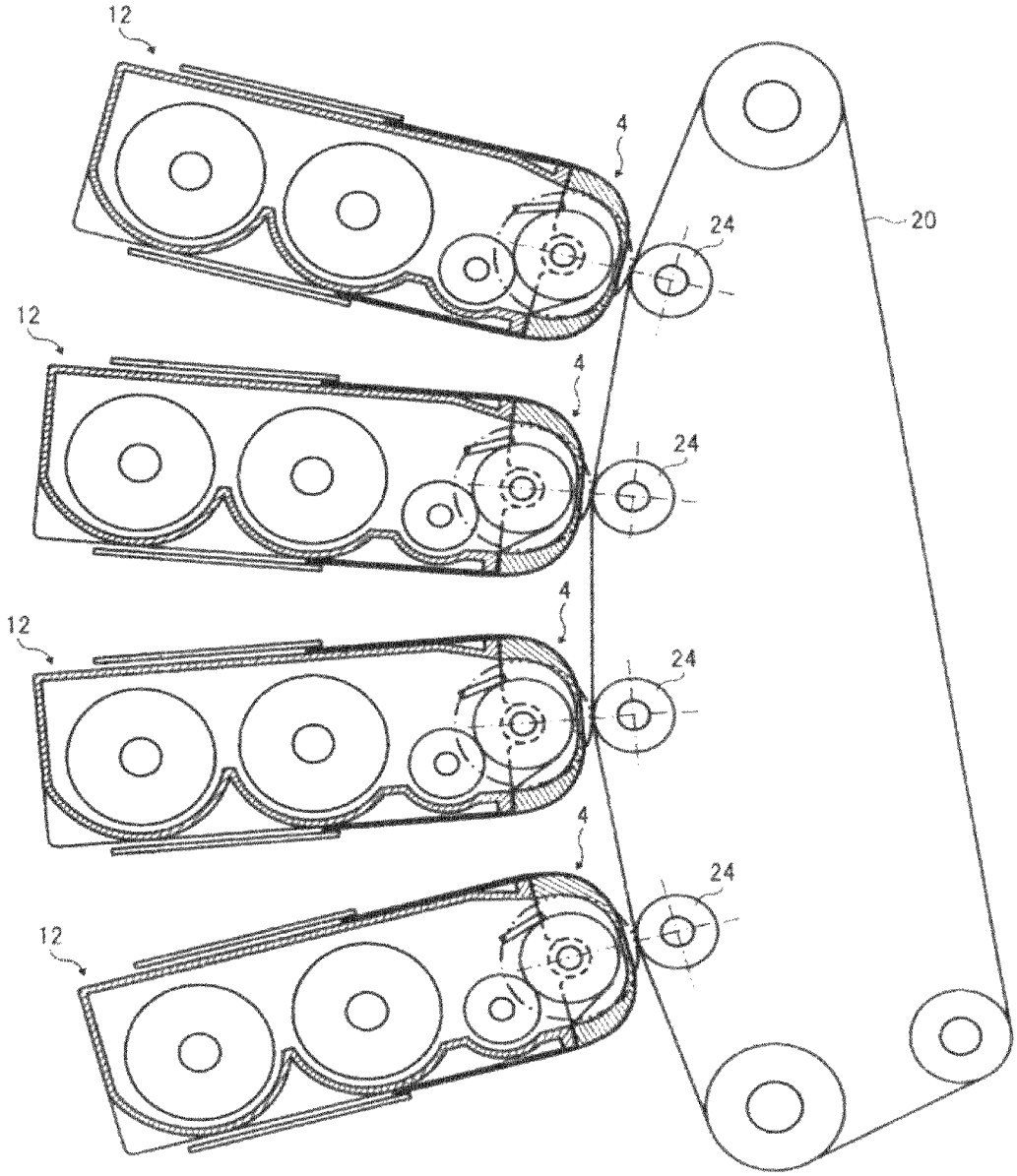
FIG. 10 is a schematic of a color image forming apparatus on which four print units are mounted.

FIG. 10 is a schematic of a color image forming apparatus on which four print units 12 are mounted.

At the four printing positions, the intermediate transfer belt 20 is wound around each of the counter rollers 24 with a winding width to some extent. However, the winding states are all different. Accordingly, the print units 12 are tilted as described above (tilted so that the virtual straight line X is aligned with the bisector (center line) of the winding angle, corresponding to the winding state of the intermediate transfer belt 20). A predetermined printing gap is formed at the printing position of each of the print units 12.

When the print units 12 are tilted in this manner, a predetermined printing gap is formed at each printing position, thereby forming a good color image. However, as is evident from FIG. 10, because the orientations of the print units 12 are different in the image forming apparatus, the image forming apparatus is formed in a configuration in which the print units 12 are spread in a fan shape about the intermediate transfer belt 20. Accordingly, the size of image forming apparatus main body is inevitably increased, and the angle direction to attach and remove the print unit 12 to and from the image forming apparatus main body is different for each color.

In the present invention, to form and set a predetermined printing gap, the print unit is formed so that only the angle of the holder to which the toner controlling unit is fixed can be adjusted relative to the developing unit. In other words, in a print unit 12' according to the present invention, only a holder 14' is tilted without tilting a developing unit 13'. Corresponding to the winding state of the intermediate transfer belt 20 to the counter roller 24, the position and angle (virtual straight line X is aligned with the bisector (center line) of the winding angle (2) of the toner controlling unit 4 (rows of toner passage holes 41) are optimized. As described above, the printing gaps relative to the intermediate transfer belt 20 from the rows of toner passage holes in the same order are made the same, in the upstream in the rotational direction and the downstream in the rotational direction viewed from the virtual straight line X.

By forming the print unit 12' as described above, the developing unit 13' need not to be tilted awkwardly corresponding to the winding state of the intermediate transfer belt to the counter roller 24. Accordingly, the orientation of the print unit 12' in the image forming apparatus can be set freely.

The present invention is described by using the intermediate transfer belt 20 as the recording medium. However, the present invention is not limited thereto, and an intermediate transfer body in a drum shape or a paper (if paper is used, the direct transfer method will be used) may be applicable.

Embodiment

Figure 1:
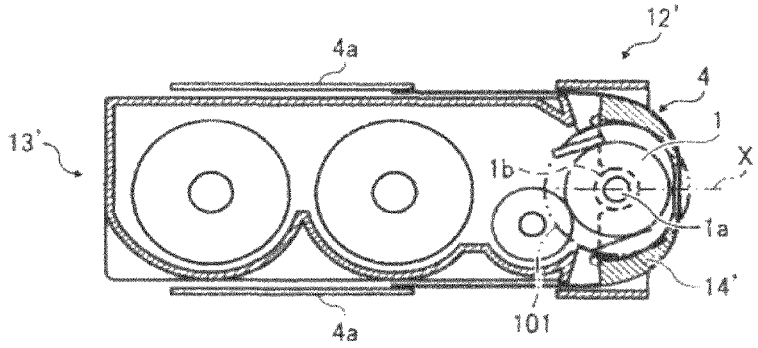
FIG. 1 is a schematic of a sectional side view of a print unit according to an embodiment of the present invention.

FIG. 1 is a schematic of a sectional side view of a print unit 12' according to the present embodiment. Because the basic elements of the image forming apparatus are the same as those in the reference examples described above, descriptions thereof will be omitted.

The print unit 12', similar to the print unit 12, mainly includes three elements of the developing unit 13' that supports the toner carrier 1, the toner controlling unit 4, and the holder 14' to which the toner controlling unit 4 is fixed, and they are integrally assembled. The print unit 12' is different from the print unit 12 in that the holder 14' forms and sets a predetermined supply gap, and the angle of the holder 14' can be freely adjusted to the developing unit 13'. Accordingly, the printing gap can be set by adjusting the angle of the holder 14' to the developing unit 13'.

In the present embodiment, the supply gap and the printing gap are set with high accuracy, and to stably maintain the accuracy, a rotation shaft 1*a* of the toner carrier 1 or a bearing 1*b* of the toner carrier 1 as shown in FIG. 1 is set as a mounting reference of the holder 14' (set reference of supply gap). The angle of the holder 14' can be adjusted, about the rotation shaft 1*a* or the bearing 1*b*. The three elements of the developing unit 13', the toner controlling unit 4, and the holder 14 are detachably connected to each other, so that the print unit 12' can be assembled and dismantled with ease, thereby enabling to replace parts, recycle, and the like.

Figure 11A:
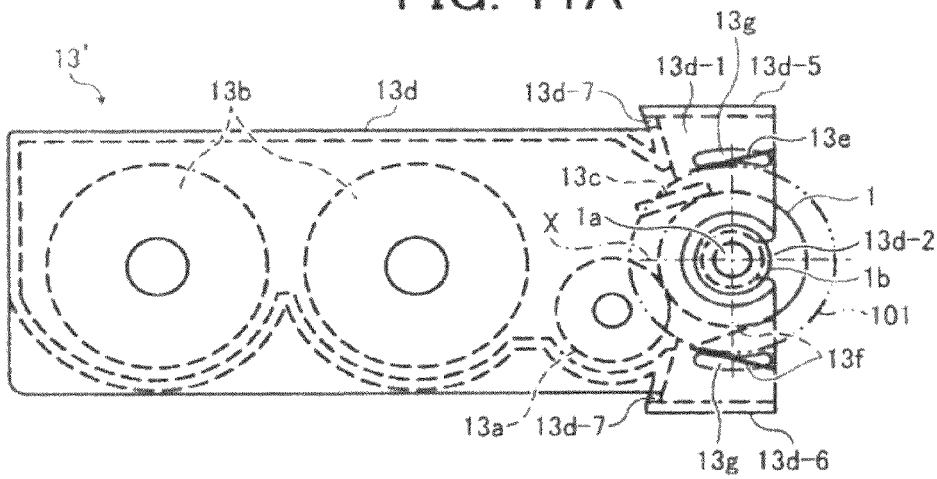
FIG. 11A is a side elevation view of a developing unit in the print unit.
Figure 11B:
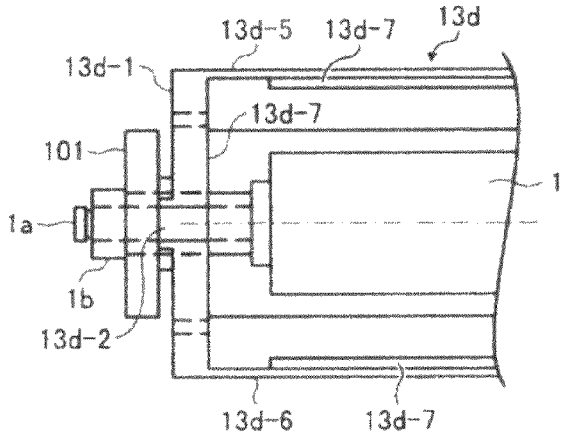
FIG. 11B is a front-view of the developing unit shown in FIG. 11A.

FIG. 11A is a side elevation view of the developing unit 13' in the print unit 12', and FIG. 11B is a front-view (partial) thereof. The developing unit 13' will now be described with reference to FIGS. 11A and 11B.

The developing unit 13' according to the present embodiment uses a two-component developer containing a magnetic carrier and a non-magnetic toner. However, a one-component toner containing a non-magnetic toner may be used, instead of the two-component developer. The developing unit 13' includes the roller-shaped toner carrier 1, a magnetic roller 13*a*, two stirring screws 13*b*, a blade 13*c* that reduces the thickness of the toner on the toner carrier 1, the case 13*d* that stores therein these elements, and the like. The two-component developer is stored in the case 13*d*.

The toner carrier 1 is rotatably supported by side plates 13*d*-1 (including a side plate at the rear of FIGS. 11A and 11B) of the case 13*d* with the rotation shaft 1*a* and the bearing 1*b* of the toner carrier 1 interposed therebetween. The toner carrier 1 is rotationally driven while being connected to a motor, which is not shown. The magnetic roller 13*a* in which a permanent magnet is included conveys the two-component developer to the toner carrier 1. A bias is then applied to a part of the toner, and the toner is transferred to the toner carrier 1 by the bias potential. The toner transferred to the toner carrier 1 is made into a cloud on the toner carrier 1, the thickness is reduced by the blade 13*c*, due to the rotation of the toner carrier 1, and delivered to a position opposite to the toner controlling unit 4. The toner controlling unit 4 then prints on a recording medium. The toner not used for printing is returned to the magnetic roller 13*a* again. The cloud is formed, because the toner adhesion to the toner carrier 1 is very low. Accordingly, the toner not used for printing and returned to the opposing position with the magnetic roller 13*a* can be easily scraped off or smoothed by a brush of the two-component developer that moves with the rotation of the magnetic roller 13*a*. By repeating the process, the toner carrier 1 always carries a certain amount of toner in a cloud state.

The rotatable rings 101 are provided at both ends of the rotation shaft 1*a* of the toner carrier 1, so as to form and set an interval (printing gap) between the toner controlling unit 4 and the recording medium such as the intermediate transfer belt highly accurately. The rings 101 and the counter roller 24 are brought into contact with each other.

The case 13*d* of the developing unit 13' is formed in a shape in which the side where the toner carrier 1 is supported (right surface side in FIG. 11A) is opened, so as to expose the toner carrier 1. This is because the assembly and individual replacement of the toner carrier 1 are taken into consideration, and the toner carrier 1 can be easily attached and removed to and from the developing unit 13'. The toner carrier 1 can be attached and removed, by just attaching and removing the bearing 1*b*, and the rotation shaft 1*a* of the toner carrier 1 can be inserted and taken out through a notch 13*d*-2 provided at a portion where the toner carrier 1 is supported by the side plates 13*d*-1.

At the opened surface (right surface side in FIG. 11A) where the toner carrier 1 is supported and exposed, the holder 14' is attached so as to cover the toner carrier 1 acts as a lid for the opened surface. Accordingly, the toner will not be spilled, scattered, or the like.

Long holes 13*d*-7 parallel to the axial direction of the toner carrier 1 are opened, at an upper plate 13*d*-5 and a lower plate 13*d*-6 of the case 13*d* at the opened surface. The long holes 13*d*-7 are long holes having the shape and size through which the toner controlling unit 4 and an electrical base material 4*a* shown in FIG. 1, integrally connected with the toner controlling unit 4 can pass. Seal members 13*e* and 13*f* in FIG. 11A prevent the free end of the holder 14' from modifying when the holder 14' is fixed, and also prevent the toner from scattering and being spilled during the rotation of the toner carrier 1. Two long holes 13*g* formed at the side plates 13*d*-1 (including the side plate at the rear in FIGS. 11A and 11B) of the case 13*d* are long holes with a curvature about the toner carrier 1. By using the long holes 13*g* at the two locations, the holder 14' whose position and angle are being set, is fixed to the developing unit 13' such as by screws.

Figure 12A:
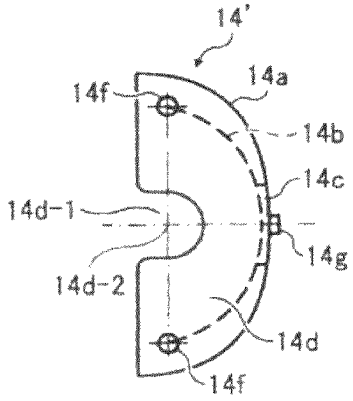
FIG. 12A is a side elevation view of a holder 14.
Figure 12B:
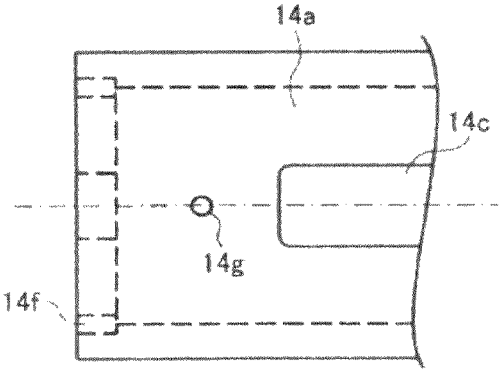
FIG. 12B is a front-view of the holder shown in FIG. 12A.

FIG. 12A is a side elevation view of the holder 14', and FIG. 12B is a front-view (partial) of the holder 14'. The holder 14' will now be explained with reference to FIGS. 12A and 12B. When the holder 14' is fixed to the developing unit 13', the holder 14' forms and sets a predetermined supply gap, when the toner controlling unit 4 (rows of toner passage holes 41) is placed opposite to the toner carrier 1. A side portion 14*a* of the holder 14' at the right side in FIG. 12A is a portion that guides substantially the entire region of the toner controlling unit 4, to determine the position of the toner controlling unit 4 and to form the surface shape (curved shape). The toner controlling unit 4 is fixed to the side portion 14*a* of the holder 14' so as to come in close contact with the side portion 14*a*.

An interior space 14*b* of the holder 14' is a large space in which the toner carrier 1 can be comfortably accommodated. The space is provided, to prevent the toner carrier 1 from being damaged, when the holder 14' is attached and removed, while the angle of the holder 14' is adjusted, and the like. When the toner carrier 1 is rotated while the holder 14' is fixed to the developing unit 13', the toner is scattered due to the air flow, if the space is narrow. The space is also provided to prevent this from happening.

At the side portion 14*a* where the toner carrier 1 and the toner controlling unit 4 are opposed to each other with the holder 14' interposed therebetween, an opening 14*c* that passes through the side portion 14*a* and the interior space 14*b* is opened with a shape and size slightly larger than the region of the rows of toner passage holes 41. The toner is caused to be sprayed from the toner carrier 1 towards the toner controlling unit 4 (rows of toner passage holes 41), through the opening 14*c*. The opening area of the opening 14*c* should be made small as much as possible. This is because, at a portion not guided by side portions 14*d*, the toner controlling unit 4 tends to bend, distort, generate vibrations, and the like. To prevent this from happening, it is better to reduce the opening area of the opening 14*c*, to an extent not to prevent the toner from being sprayed, so that the side portions 14*d* can guide the toner controlling unit 4 over a wide range.

By forming the holder 14' as described above, the toner controlling unit 4 can form and set a desired surface shape at a precise position.

A U-shaped notch 14*d*-1 fitted with the bearing 1*b* of the toner carrier 1 is provided at the side portion 14*d* at the front side in FIG. 12A. The fitting relationship between the bearing 1*b* and the notch 14*d*-1 is in the vertical direction and the horizontal direction (positioning in the horizontal direction is the right side only) of the holder 14' in FIG. 12A, and the center of the bearing 1*b*, in other words, the center of the rotation shaft of the toner carrier 1 is overlapped with a center position 4*d*-2 of the notch 14*d*-1. In other words, this position is the mounting reference (set reference of supply gap) of the holder 14' relative to the developing unit 13' (toner carrier 1), and is the center about which the angle of the holder 14' is adjusted. The bearing 1*b* is inserted into the end of the U-shaped notch 14*d*-1, and the angle of the holder 14' is adjusted about the bearing 1*b* at this state. Accordingly, the position and angle of the toner controlling unit 4 (rows of toner passage holes 41) relative to the developing unit 13' (toner carrier 1) can be optimized.

As described above, the holder 14' is included in the developing unit 13', so as to act as a lid for the opened surface (right surface side in FIG. 11A) of the developing unit 13'. The side portions 14*d* provided at the front and end of the holder 14' in FIG. 12A come into close contact and fixed with an inner side portion 13*d*-7 where the toner carrier 1 is supported by the side plates 13*d*-1 of the case 13*d* of the developing unit 13' (see FIG. 13B). Accordingly, the holder 14' is positioned relative to the developing unit 13' in the rotation shaft direction of the toner carrier. After the position and angle of the holder 14' are set, the holder 14' is fitted and fixed to the developing unit 13' by screws and the like, through two screw holes 14*f* and the two long holes 13*g* of the developing unit 13'.

The assembly and individual replacement of the toner carrier 1 are taken into consideration, so that the toner carrier 1 can be attached and removed to and from the developing unit 13' with ease, by just fitting or removing the bearing 1*b*. Needless to say, the holder 14' may be removed by unscrewing the fixing screw, and pulling out from the bearing 1*b* along the U-shaped notch 14*d*-1 with which is in a fitting relationship.

Accordingly, the assembly and setting of the print unit 12' as a single body, in other words, the assembly and setting of the holder 14' and the toner controlling unit 4 based on the toner carrier 1 is completed. The setting of the angle of the holder 14' corresponding to the winding state of the intermediate transfer belt 20, when the print unit 12' is mounted on the image forming apparatus, will be described below.

In the present embodiment, as shown in FIG. 1, the electrical base material 4*a* that drives and controls the toner controlling unit 4 is integrally connected to the end of the toner controlling unit 4. The toner controlling unit 4 is fixed to the holder 14', for example, as shown in FIG. 12B, by providing a convex portion 14*g* used to determine the position of the toner controlling unit 4 relative to the holder 14', at regions near both ends of the holder 14' in the lengthwise direction. A hole that fits with the convex portion 14*g* is opened in the toner controlling unit 4, the hole is fitted into the convex portion 14*g*, and the toner controlling unit 4 is positioned relative to the holder 14'. The toner controlling unit 4 is then adhered to the holder 14, by using an adhesive, a pressure-sensitive adhesive (including double-stick tape), and the like.

The toner controlling unit 4 fixed to the holder 14' is fixed to the developing unit 13' with the holder 14', after the supply gap and the angle are set. In the configuration of the print unit 12' according to the present embodiment, the operations of setting and fixing are performed, after the electrical base material 4*a* of the toner controlling unit 4 is passed through the long holes 13*d*-7 of the developing unit 13' shown in FIGS. 11A and 11B.

If the toner controlling unit 4 that requires replacement, reuse, or the like is used, the toner controlling unit 4 needs to be easily removed from the holder 14'. In such an event, instead of adhering the toner controlling unit 4 to the holder 14' by using the adhesive, the pressure-sensitive adhesive, and the like, a method of closely bringing the toner controlling unit 4 into contact with the holder 14', by pulling the electrical base material 4*a* towards the direction to which the tension is applied, by a spring and the like may be applied.

If by any chance a desired surface shape cannot be obtained, because the toner controlling unit 4 is bent and distorted, even if the toner controlling unit 4 is fixed to the holder 14', a reinforcement of a thin plate such as a stainless steel plate may be adhered to the toner controlling unit 4 or the holder 14', while paying careful attention to the electrical failure (short circuit, leakage, and the like) from occurring.

Figure 13A:
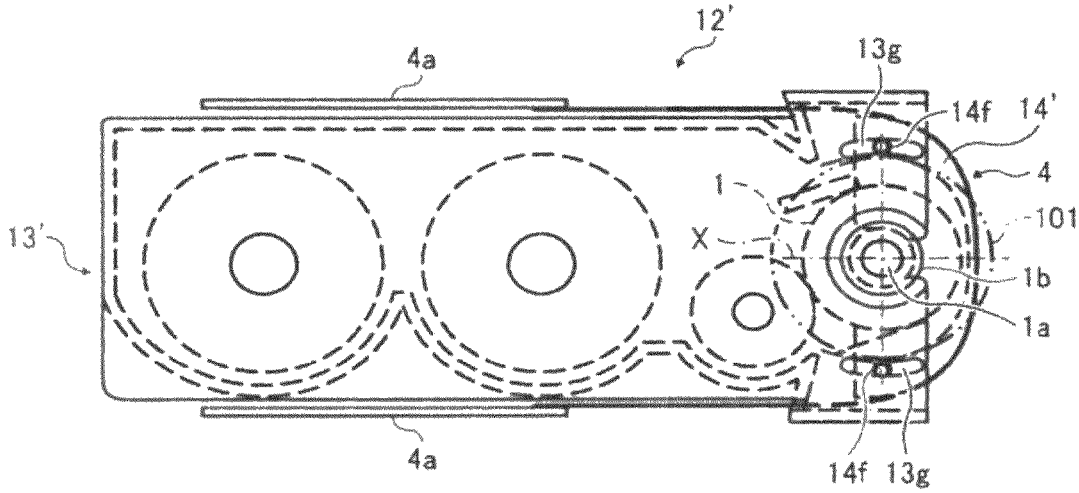
FIG. 13A is a side elevation view of a print unit in which the position and angle of the holder on which the toner controlling unit is mounted are set relative to the developing unit, based on a bearing of a toner carrier.
Figure 13B:
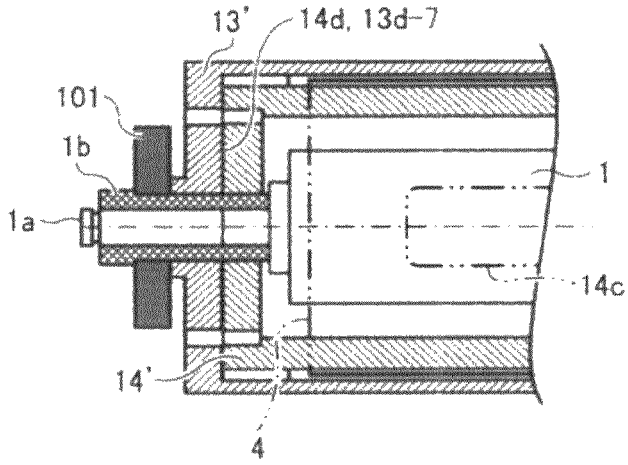
FIG. 13B is a front sectional view sectioned at the toner carrier of FIG. 13A.

FIG. 13A is a side elevation view of the print unit 12' in which the position and angle of the holder 14' on which the toner controlling unit 4 is mounted are set relative to the developing unit 13', based on the bearing 1*b* of the toner carrier 1. The position and angle of the holder 14' on which the toner controlling unit 4 is mounted may be set relative to the developing unit 13', based on the rotation shaft 1*a* of the toner carrier 1. In FIG. 13A, screws used to fix the holder 14' to the developing unit 13' are not shown. FIG. 13B is a front sectional view sectioned at the toner carrier 1 of FIG. 13A. The configurations, the positional relationship, the fitting relationship, and the like of the toner carrier 1, the developing unit 13', and the holder 14' described in FIGS. 11A, 11B, 12A, and 12B may be easily understood, by also referring to FIGS. 13A and 13B.

Figure 14A:
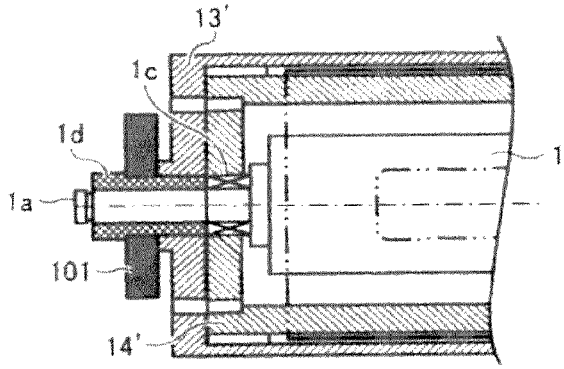
FIG. 14A is a schematic of an example of the bearing.
Figure 14B:
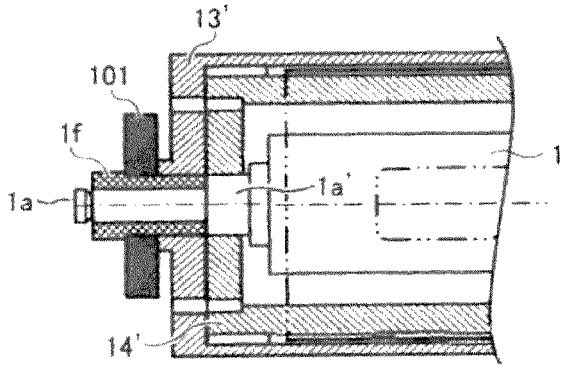
FIG. 14B is a schematic of another example of the bearing.

FIG. 14B is another example of a bearing member of the toner carrier 1. The bearing 1*b* of FIG. 13B is a long bearing that has portions to support the toner carrier 1 to the developing unit 13', to which the ring 101 is fixed, and to fit with the holder 14'. A bearing if of FIG. 14B is a short bearing that only has a portion to support the toner carrier 1 to the developing unit 13', and a portion to which the ring 101 is fixed.

In FIG. 14B, a large diameter portion 1*a'* obtained by enlarging a part of the rotation shaft 1*a* and the fitting portion of the holder 14' are fitted to each other. In such an event, at least the fitting portion between the large diameter portion 1*a'* and the holder 14' needs to be an insulating resin and slidable.

In FIG. 14A, the bearing is formed so that the bearing 1*b* in FIG. 13B is divided. In FIG. 14A, two bearings of a bearing 1*c* that fits with the holder 14' and a bearing 1*d* that has portions to support the toner carrier 1 to the developing unit 13' and to which the ring 101 is fixed are used.

In general, a slide bearing made of resin is usually used as a bearing for the developing unit, from the insulation characteristics and cost point of view. In FIG. 13B, the sliding bearing is used as the bearing lb. To improve the setting accuracy of the position and angle of the holder 14' (toner controlling unit 4), the accuracy is influenced by bearing accuracy that is the set reference. Accordingly, in FIG. 14A, the sliding bearing is used for the bearing 1*d*, but for the bearing 1*c* fitted with the holder 14', other highly accurate bearing such as a rolling ball bearing, different from the bearing 1*d*, is used.

Figure 14C:
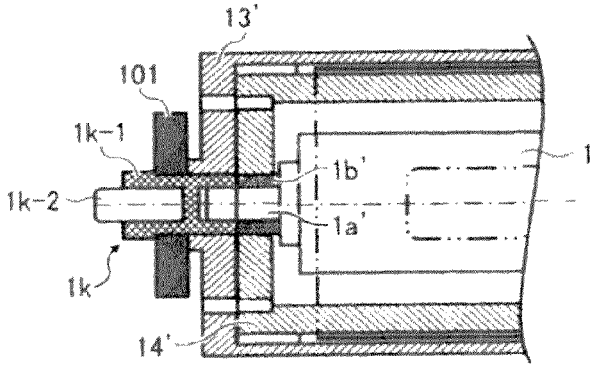
FIG. 14C is a schematic of further another example of the bearing.

FIG. 14C is an example in which a unit support member 1*k* that also acts as a bearing, is used instead of the bearing 1*b* of the toner carrier of the print unit 12' (developing unit 13') in FIG. 13B.

A plurality of electrodes is aligned on the surface of the toner carrier 1, and the toner is made into a cloud by applying a voltage to each of the electrodes through the rotation shaft 1*a* and the bearing lb. In the configuration in which the rotation shaft 1*a*, the bearing 1*b*, and the like are exposed, as shown in FIG. 13B, problems such as a leakage, a short-circuit, and a contact failure tend to occur.

Accordingly, as shown in FIG. 14C, a short rotation shaft 1*a"* is used as the rotation shaft of the toner carrier 1, and the rotation shaft 1*a"* and a bearing 1*b'* are hidden from outside, by supporting the rotation shaft 1*a"* with both the short bearing 1*b'* that only fits with the holder 14' and the unit support member 1*k*.

The unit support member 1*k* includes an insulated bearing member 1*k*-1 having a hole that rotatably supports the rotation shaft 1*a"* as a bearing, and a shaft 1*k*-2 used to mount the print unit 12' on the image forming apparatus main body and the like.

Figure 15:
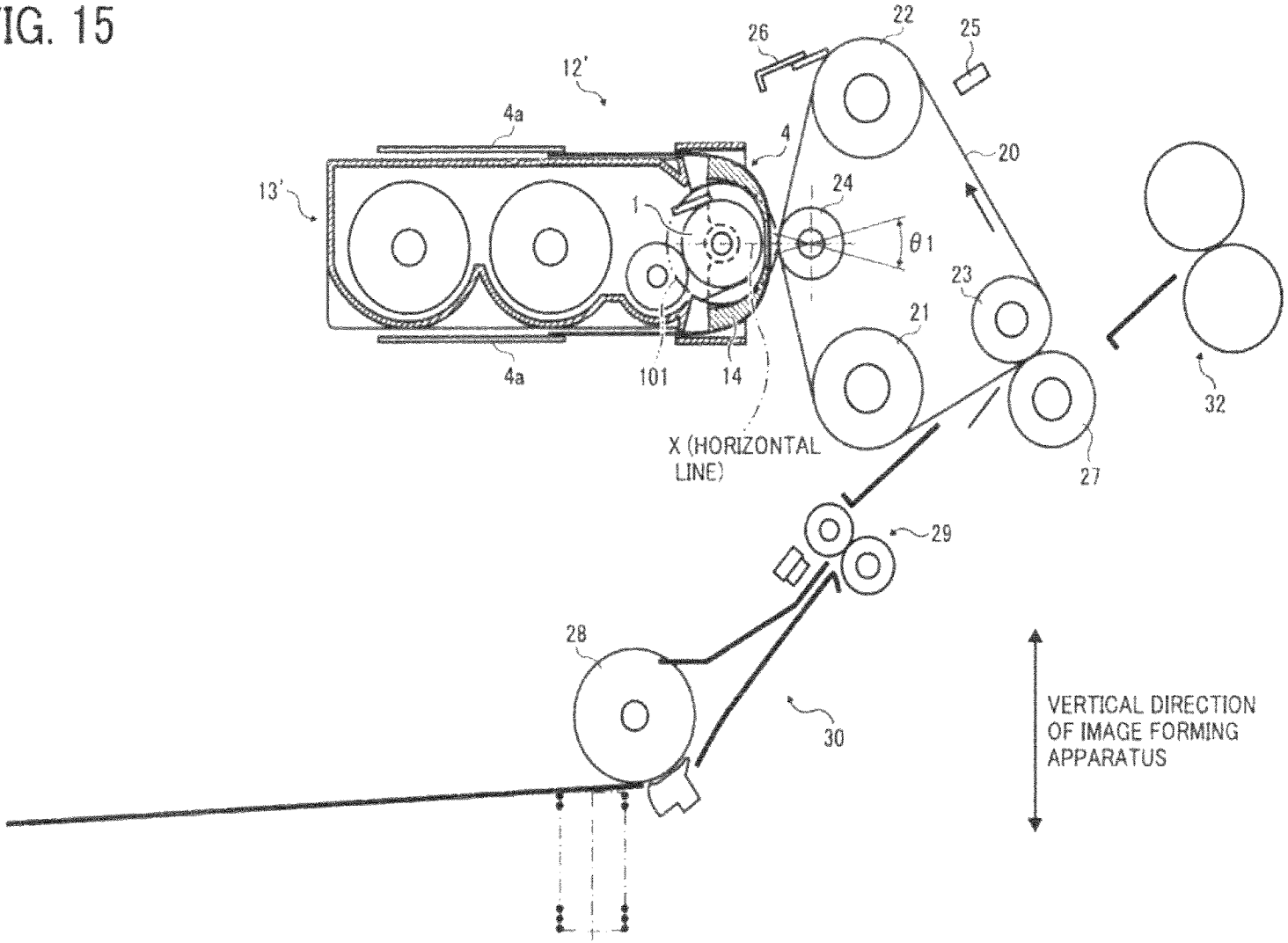
FIG. 15 is a schematic of an image forming apparatus on which a print unit including a holder whose angle can be adjusted is mounted.

FIG. 15 is a schematic of the image forming apparatus shown in FIG. 6 on which the print unit 12' including the holder 14' whose angle can be adjusted according to the present embodiment is mounted. In FIG. 6, the bisector (center line) of the winding angle θ1 of the intermediate transfer belt 20 is on the horizontal line, thereby arranging the print unit 12 horizontally. In FIG. 15, to arrange the print unit 12' so as to have the same orientation, the developing unit 13' is arranged in the horizontal orientation, so that the center of the rotation shaft of the toner carrier 1 is aligned with the bisector (center line) of the winding angle θ1, in other words, on the horizontal line, by using the ring 101. The angle of the holder 14' is then set, so that the virtual straight line X that passes through the positions of the center of the rotation shaft of the toner carrier 1 of the developing unit 13' and the center of the toner controlling unit 4 (rows of toner passage holes 41) is aligned with the bisector (center line) of the winding angle θ1, in other words, the horizontal line. The enlarged view of the printing position at this time is the same as that in FIG. 7.

Figure 16:
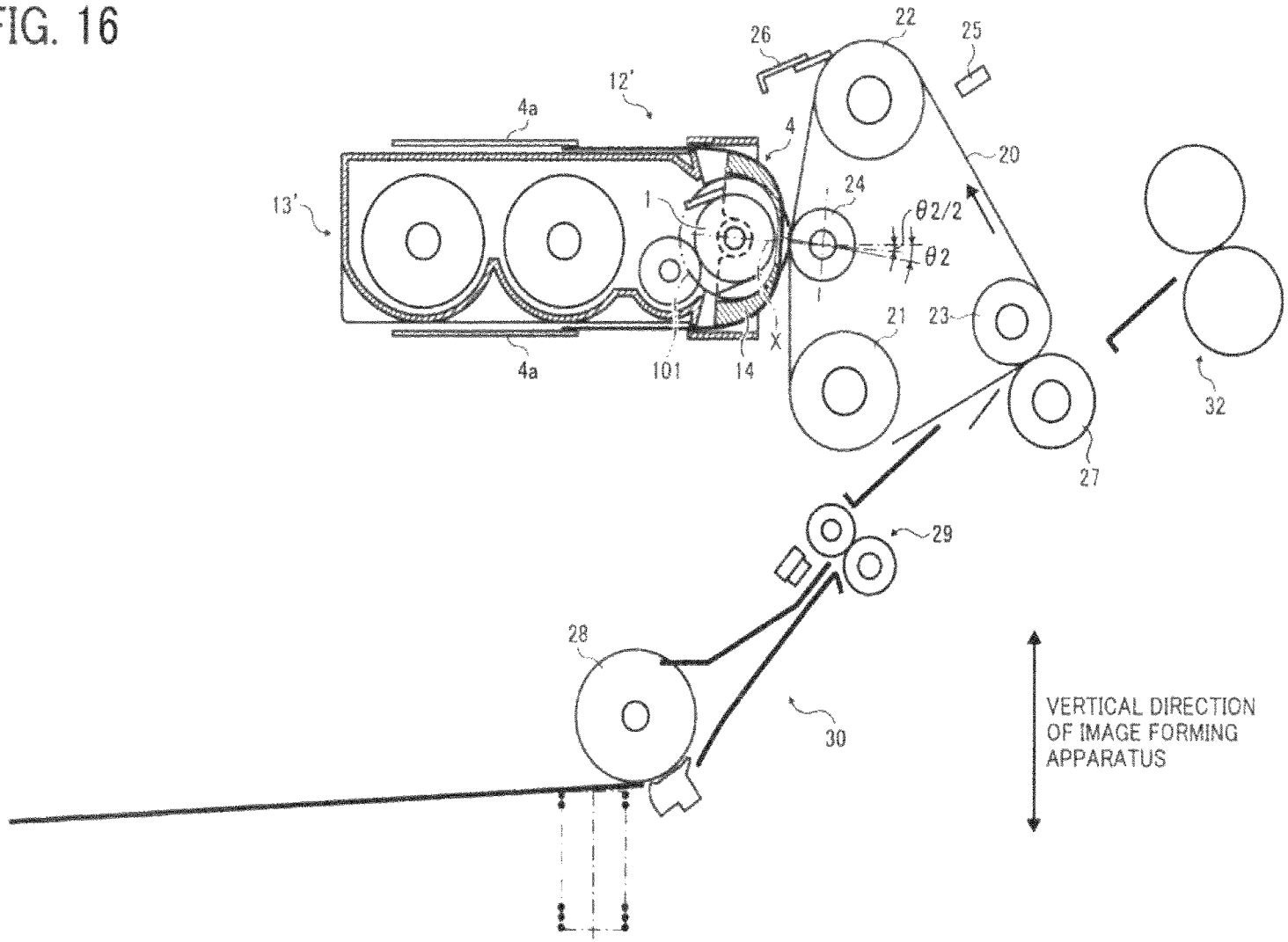
FIG. 16 is a schematic of another image forming apparatus on which a print unit including a holder whose angle can be adjusted is mounted.

FIG. 16 is a schematic of the image forming apparatus shown in FIG. 8C, on which the print unit 12' including the holder 14' whose angle can be adjusted according to the present embodiment is mounted. In the winding state of the intermediate transfer belt 20 relative to the counter roller 24 shown in FIG. 8C, the virtual straight line X needs to be tilted by θ2/2 to the horizontal line, so as to align the virtual straight line X with the bisector (center line) of the winding angle η2. In the print unit 12 in FIG. 8C, the print unit 12 is obliquely mounted on the image forming apparatus, as described above. Accordingly, the print unit 12 cannot be horizontally arranged in the image forming apparatus.

In the present embodiment, the orientation of the developing unit 13' is horizontally arranged, by aligning the center of the rotation shaft of the toner carrier 1 with the bisector (center line) of the winding angle η2, by using the ring 101. The angle of the holder 14' is then set, so that the virtual straight line X that passes through the positions of the center of the rotation shaft of the toner carrier 1 of the developing unit 13' and the center of the toner controlling unit 4 (rows of toner passage holes 41), is aligned with the bisector (center line) of the winding angle η2, in other words, the line tilted by θ2/2 that passes through the center of the rotation shaft of the counter roller 24. The enlarged view of the printing position at this time is the same as that in FIG. 8D.

Accordingly, it is possible to horizontally arrange the print unit 12' (developing unit 13') in the image forming apparatus, while securing the printing gap highly accurately.

Figure 17:
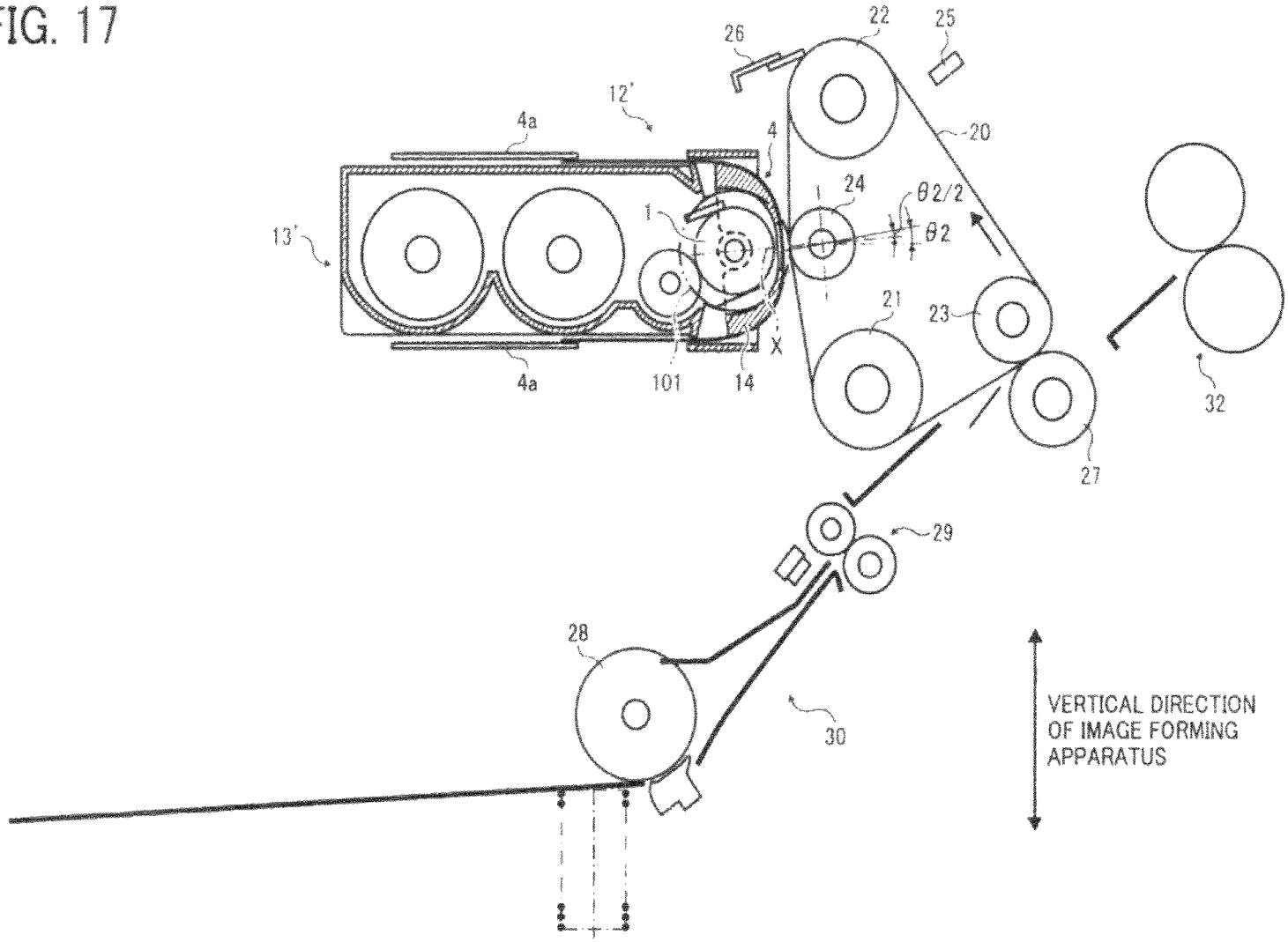
FIG. 17 is a schematic of further another image forming apparatus on which a print unit including a holder whose angle can be adjusted is mounted.

FIG. 17 is a schematic of the image forming apparatus shown in FIG. 9C on which the print unit 12' including the holder 14' whose angle can be adjusted according to the present embodiment is mounted. Because the only difference from FIG. 16 is that the direction of angle to which the holder 14' is tilted, descriptions thereof will be omitted. The enlarged view of the printing position is the same as that in FIG. 9D.

In the present embodiment, the print unit 12' (developing unit 13') is horizontally arranged in the image forming apparatus, by setting the supply gap and the printing gap, in other words, by setting the optimal position and angle of the toner controlling unit 4 (rows of toner passage holes 41) relative to the intermediate transfer belt 20, by using the holder 14'. If the holder structure such as that of the present embodiment is employed, regardless of the desired orientation (such as an orientation with an arbitrary inclination angle relative to the vertical orientation and the horizontal direction) of the print unit 12' (developing unit 13') in the image forming apparatus, it is possible to correspond to any orientation.

In this manner, with the present embodiment, regardless of the winding state (winding angle and winding position) of the intermediate transfer belt 20 wound around the counter roller 24, and regardless of the desired orientation setting of the print unit 12' (developing unit 13') in the image forming apparatus, the setting of a predetermined printing gap, in other words, the setting of an optimal position and angle of the toner controlling unit (rows of toner passage holes 41) relative to the intermediate transfer belt 20 can be performed, by adjusting the angle of the holder 14' to the developing unit 13'.

A color image forming apparatus on which a plurality of print units 12' according to the present embodiment is mounted will now be described.

Figure 18:
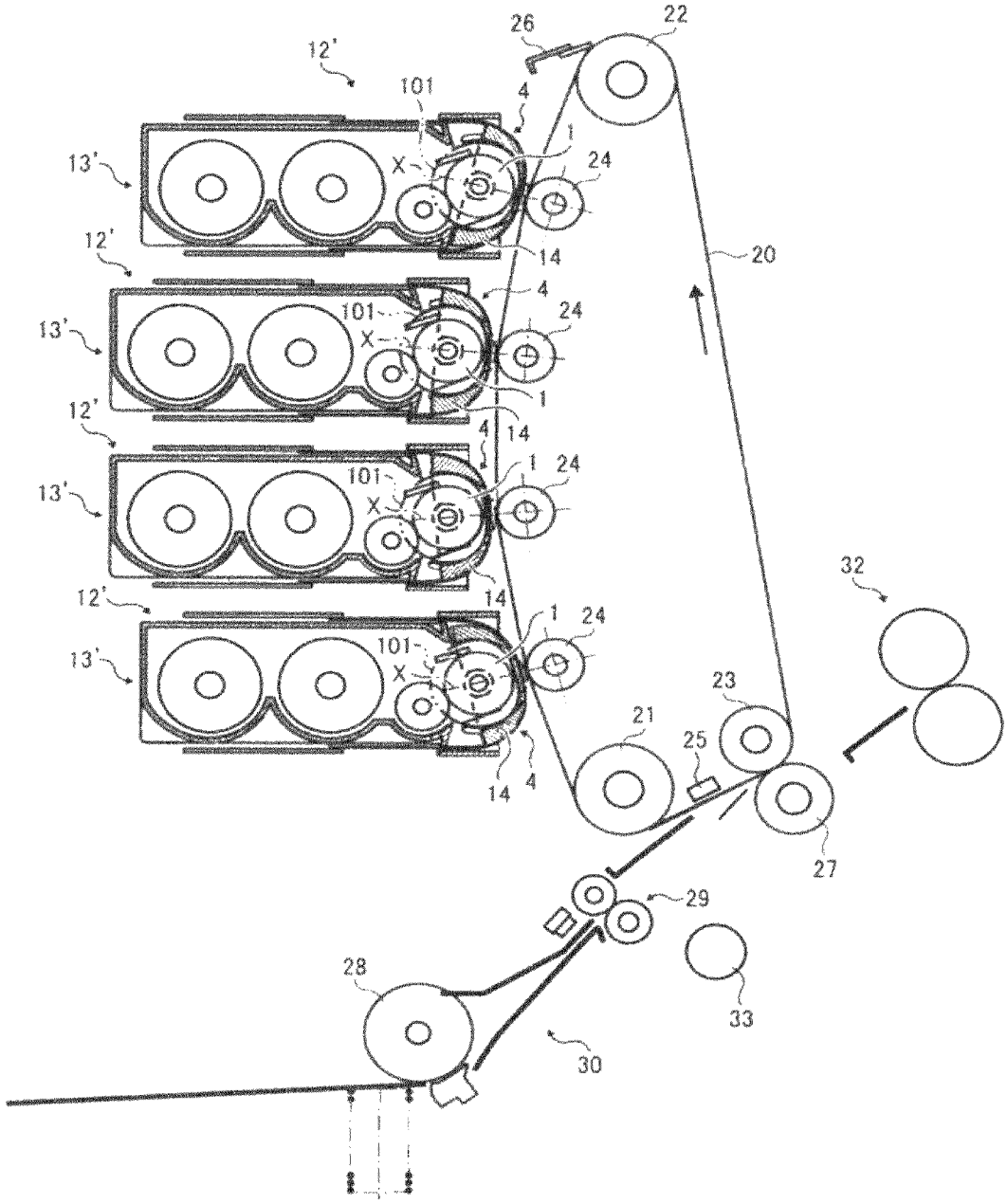
FIG. 18 is a schematic side elevation view of a color image forming apparatus that uses an intermediate transfer belt and on which four-color print units are mounted.
Figure 19:
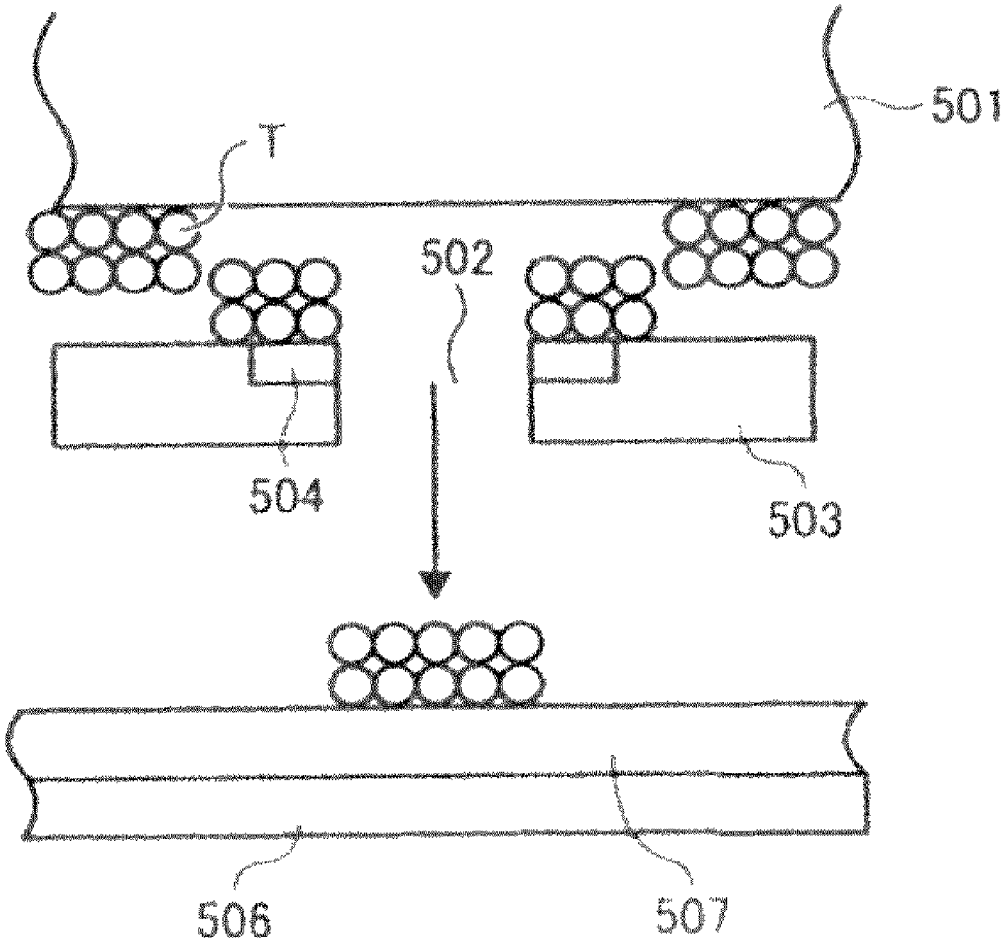
FIG. 19 is a schematic of a basic configuration of a conventional direct recording type apparatus.
Figure 20:
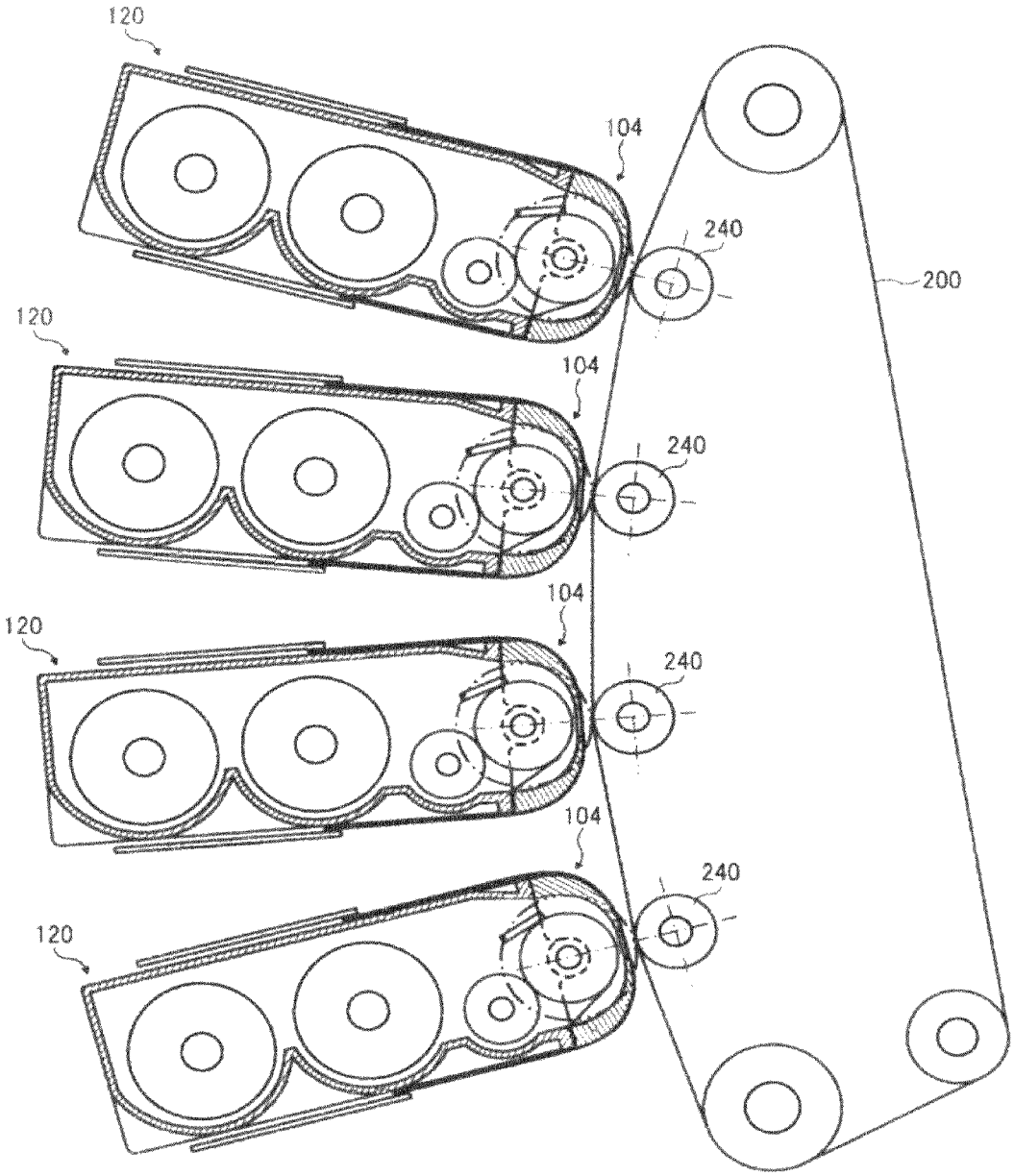
FIG. 20 is a schematic of a color image forming apparatus on which conventional four image forming devices are mounted.

FIG. 18 is a schematic side elevation view of the color image forming apparatus that uses the intermediate transfer belt 20 as a recording medium and on which four-color print units 12' are mounted. The color image forming apparatus makes a toner into a cloud and forms toner images on the intermediate transfer belt 20, by using the print units 12' that ON-OFF control the passing of a toner by the toner controlling unit. The color image forming apparatus also forms a color image by sequentially overlapping the toner images on the intermediate transfer belt 20 with one rotation of the intermediate transfer belt 20. Because toner images of each color are directly overlapped on the intermediate transfer belt 20, the positional deviation of the image can be reduced.

The image forming apparatus is approximately the same as that in FIG. 6, except the configuration and the number of the print units.

In the color image forming apparatus, the intermediate transfer belt 20 is stretched by the drive roller 21, the tension roller 22, the transfer counter roller 23, the four counter rollers 24 that are rear electrodes, and the like. The intermediate transfer belt 20 is perpendicularly and substantially vertically arranged. The intermediate transfer belt 20 is rotated in the anti-clockwise direction by a motor, which is not shown, connected to the drive roller 21. On the stretched surface of the intermediate transfer belt 20 at the left side in FIG. 18 (the side opposite to where the counter rollers 24 are provided with the intermediate transfer belt 20 interposed therebetween), four print units 12' according to the present embodiment having the same structure are sequentially arranged in the moving direction of the intermediate transfer belt 20, at a predetermined interval, so as to be stacked. The cleaning unit 26 in FIG. 18 cleans residual toner on the intermediate transfer belt 20.

All the print units 12' are transversely and horizontally arranged in the color image forming apparatus. The toner controlling units 4 of the print units 12' are placed opposite to the counter rollers 24 with the intermediate transfer belt 20 interposed therebetween, and the toner controlling units 4 are disposed apart from the intermediate transfer belt 20, as much as a predetermined printing gap (a few hundred micrometers). The positions are the printing positions.

The printing gap of each color is formed and set by adjusting each angle of the holders 14' of the print units 12', corresponding to the winding state of the intermediate transfer belt 20 relative to the counter roller 24 at each of the printing positions, so that the positions and angles of the toner controlling units 4 (rows of toner passage holes 41) to the intermediate transfer belt 20 are optimized. In other words, a predetermined printing gap is set, by horizontally arranging the print units 12' (developing units 13') of each color in the color image forming apparatus, and aligning the virtual straight lines X of the print units of each color with the bisector (center line) of the winding angle, corresponding to the winding state of the intermediate transfer belt 20 relative to the counter rollers 24, by adjusting the angles of the holders 14'. Accordingly, the positions and angles of the toner controlling units 4 (rows of toner passage holes 41) can be optimized.

The color image forming apparatus also includes the transfer roller 27 that forms a transferring unit with the transfer counter roller 23 with the intermediate transfer belt 20 interposed therebetween, the mark sensor 25 that generates reference signals used for an image forming operation between the drive roller 21 and the transfer counter roller 23 in the loop of the intermediate transfer belt 20, and the like.

Below the intermediate transfer belt 20, the sheet feeding and conveying unit 30 formed of the sheet feeding roller 28, the pair of registration rollers 29, and the like are arranged at the loading side of the transferring unit, and the fixing device 32 is arranged at the unloading side of the transferring unit, so that the paper conveying direction is oblique to the transferring unit formed of the transfer roller 27 and the transfer counter roller 23 with the intermediate transfer belt 20 interposed therebetween. The color image forming apparatus main body also includes a rotation shaft 33. Accordingly, it is possible to integrally separate the intermediate transfer belt 20, the transferring unit, the fixing device 32, and the like from the apparatus main body, while leaving the print units 12', the sheet feeding and conveying unit 30, and the like in the apparatus main body. The attachment, removal, and replacement of the print units 12' to and from the color image forming apparatus main body are performed after the separation is carried out.

Toner colors of yellow (Y), magenta (M), cyan (C), and black (Bk) are stored in the print units 12', and in each of the print units 12', the toner is made into a cloud by the toner carrier 1, and delivered to the position opposite to the toner controlling unit 4. The toner is then selectively caused to be sprayed above the intermediate transfer belt 20, by the electric field of the control electrodes 42 that ON-OFF controls the passing of the toner, at the rows of toner passage holes 41 of the toner controlling unit 4. After toner images of each color are formed on the intermediate transfer belt 20, the toner images of four colors are overlapped, and the overlapped toner images proceed to the transferring unit.

In synchronization with the printing and the image forming operation as described above, a sequence of conveying sheets is operated by the sheet feeding and conveying unit 30. A sheet is conveyed by the sheet feeding roller 28 and the pair of registration rollers 29, and come into contact with the surface of the intermediate transfer belt 20 so as to slide along the surface. In the transferring unit, the toner images and the sheet are overlapped, and the toner images of four colors on the intermediate transfer belt 20 are integrally transferred onto the sheet, because bias is applied from the transfer roller 27. The sheet to which the image is transferred is separated from the intermediate transfer belt 20 by a neutralizing needle and the like, which is not shown, and sent to the fixing device 32. Accordingly, the toner image is fixed on the sheet. The residual toner remained on the intermediate transfer belt 20 is cleaned by the cleaning unit 26 after the toner image is transferred to the sheet, and the intermediate transfer belt 20 then waits for the next image forming process.

With such a color image forming apparatus, four colors of toner images are formed and overlapped on the intermediate transfer belt 20, and a color image is produced with one rotation of the intermediate transfer belt 20. Accordingly, a high-definition color image can be produced at a high speed, and the size of the color image forming apparatus can be reduced.

With the present embodiment, even if the winding state (winding position and angle) of the intermediate transfer belt 20 wound around the counter roller 24 at the printing position may vary for each color, a predetermined printing gap can be formed and set accordingly. All the print units 12' in the color image forming apparatus can be arranged in desired orientations (in FIG. 18, all the print units 12' have the same orientation in the horizontal direction). Accordingly, advantages such as the size can further be reduced (conventionally, as in FIG. 10, because the print units 12 are arranged in a fan shape, the size is inevitably increased), the attaching and detaching operability can be enhanced, because the attachment and detachment directions, and the angles of the print units 12' are limited, and the like.

In FIG. 18, all the print units 12' have the same horizontal orientation. However, the orientations of all the print units 12' may be inclined to the horizontal direction at a certain inclination angle. Depending on the concept and layout of the color image forming apparatus, corresponding to the stretching mode of the intermediate transfer belt 20, the orientations of the print units 12' may be intentionally varied, such as by combining the horizontal arrangement and vertical arrangement, or arranging all the inclination angles differently. The print units 12' according to the present embodiment can easily correspond with such an event.

The print unit 12' according to the present embodiment using the intermediate transfer belt 20 as a recording medium. However, the present invention is not limited thereto, and an intermediate transfer body in a drum shape may be used, or an image forming apparatus in which the toner is directly printed on the sheet, without using the intermediate transfer body, may be used. If the intermediate transfer body in a drum shape is used, the virtual straight line X is set so as to pass through the center of the drum. If the sheet is used, similar to the intermediate transfer belt 20, the setting is performed based on the winding state of the sheet wound around the counter roller 24.

With the present embodiment, in an image forming device including a casing that stores therein an image forming agent, an agent carrier rotatably that is supported by the casing, faces outside of the casing through an opening formed on the casing, and carries the image forming agent stored in the casing, a sheet-like hole defining member that defines a row of a plurality of holes therein in an axial direction of the agent carrier, and arranged opposite to the agent carrier with a predetermined interval therebetween, a plurality of spray electrodes that is provided on the hole defining member in a manner corresponding to the holes, and forms an electric field for selectively causing the image forming agent to be sprayed from the agent carrier towards the holes, and a positioning member that is provided on the casing so as to cover the agent carrier, at least holds the hole defining member in the axial direction of the agent carrier by side walls of the positioning member having a portion defining an opening at a location opposite to the row of holes in the hole defining member, and positions the hole defining member with respect to the agent carrier so that relative positions of the agent carrier and the hole defining member are in a predetermined positional relationship. The image forming device is for use in an image forming apparatus that, based on image information, forms an image by depositing the image forming agent selectively caused to be sprayed from the agent carrier by forming a spraying electric field, and having passed through the holes, on a recording member arranged in the image forming apparatus opposite to the agent carrier with the hole defining member interposed therebetween, and wound around and brought into contact with a counter electrode for forming an electric field that attracts the image forming agent caused to be sprayed from the agent carrier, and an angle of the positioning member is adjustable relative to the casing about a rotation shaft that is coaxial with the agent carrier. Accordingly, as described above, the supply gap and the printing gap can be set and maintain, for example, with high accuracy, thereby high quality images can be formed. Consequently, the orientation of the print unit can be set at a predetermined orientation.

With the present embodiment, the positioning member is detachably formed on the casing in a state in which the positioning member alone or the hole defining member is arranged along the side walls, with the positioning member mounted on the casing, the positioning member is positioned relative to the casing, by engagement of an engaging portion provided on a bearing member attached to a shaft of the agent carrier or to the agent carrier and an engaged portion provided on the positioning member, and the angle of the positioning member is adjustable relative to the casing about the shaft of the agent carrier. Accordingly, the gaps can be set and maintained, for example, with higher accuracy.

With the present embodiment, the angle of the positioning member is adjustable relative to the casing in a state in which the positioning member alone or the hole defining member is arranged along the side walls. Accordingly, it is possible to improve workability in setting the angle of the positioning member.

With the present embodiment, a ball bearing is used as a bearing member attached to the agent carrier. This structure improves the accuracy of fixing the positioning member on the agent carrier, whereby the supply gap and the printing gap can be set and maintained with high accuracy. This structure also reduces risks such as leakage of the voltage applied to the agent carrier and a short-circuit.

With the present embodiment, the positioning member is a cover member provided on the casing so as to cover the opening formed on the casing and having a portion defining a second opening at a location opposite to the agent carrier, and holds the hole defining member along outer peripheral surfaces of the side walls that define the second opening of the cover member therein. Accordingly, the positioning member performs functions of positioning the hole defining member relative to the agent carrier, and preventing a developing agent stored in the casing from scattering from the opening formed on the casing.

With the present embodiment, an image forming apparatus includes an image forming unit that has a casing for storing an image forming agent therein, an agent carrier rotatably supported by the casing, facing outside of the casing through an opening formed on the casing, and carrying the image forming agent stored in the casing, a sheet-like hole defining member defining a row of a plurality of holes therein in an axial direction of the agent carrier and arranged opposite to the agent carrier with a predetermined interval therebetween, and a plurality of spray electrodes provided on the hole defining member in a manner corresponding to the holes and forming an electric field for selectively causing the image forming agent to be sprayed from the agent carrier towards the holes, and a counter electrode that is arranged opposite to the agent carrier with the hole defining member interposed therebetween, and forms an electric field for attracting the image forming agent caused to be sprayed from the agent carrier. Based on image information, the image forming apparatus forms an image by deposing the image forming agent selectively caused to be sprayed from the agent carrier by forming a spraying electric field on a recording member, after moving the image forming agent towards the counter electrode through the holes, and the image forming unit is the print unit 12' of the present invention. Because the print unit that can set a supply gap and an optimal printing gap, in other words, that can set the optimal position and angle of the hole defining member (toner passage holes) relative to the recording member is mounted, it is possible to provide an image forming apparatus that can form high quality images.

With the present embodiment, when the hole defining member is arranged opposite to the recording member, an interval between the hole defining member and the recording member is set as a predetermined printing gap by adjusting an angle of the positioning member relative to the casing. Accordingly, the supply gap and the printing gap of the print unit can be set and maintained, for example, with high accuracy, whereby high quality images can be formed. Furthermore, because the print unit in the image forming apparatus can be set to a predetermined orientation, it is possible to further downsize the image forming apparatus and improve the attaching and detaching operability of the print unit, for example.

With the present embodiment, when the hole defining member is arranged so that the row of holes is placed within an acceptable gap range of the printing gap set in advance, the angle of the positioning member is adjustably set so that the center in a direction perpendicular to the direction of the row of holes is closest to the recording member within the acceptable gap range.

With the present embodiment, when the hole defining member is arranged so that the row of holes is placed within an acceptable gap range of the printing gap set in advance, the angle of the positioning member is adjustably set, so that the center in a direction perpendicular to the direction of the row of holes is closest to the recording member within the acceptable gap range. Accordingly, as described above, the size of the printing gap located upstream in the moving direction of the recording member and the size of the printing gap located downstream in the moving direction of the recording member can be the same based on the center in the direction perpendicular to the direction of the row of holes.

With the present embodiment, the row of holes is provided in plurality in a rotational direction of the agent carrier, and when a predetermined printing gap is formed at a position where the rows of holes are opposed to the recording member, an angle of the positioning member is adjustably set, by referring to a virtual straight line that passes through the center of a rotation shaft of the agent carrier and the center in a direction perpendicular to the direction of the rows of holes, and counting orders of rows of holes located upstream in the rotational direction of the agent carrier and downstream in the rotational direction of the agent carrier, so that printing gaps between the row of holes located upstream in the rotational direction of the agent carrier and the row of holes located downstream in the rotational direction of the agent carrier in the same row order are the same. Accordingly, as described above, the printing gaps between the rows of toner passage holes in the same order can be the same, by counting the orders of the rows of toner passage holes located upstream in the rotational direction and downstream in the rotational direction based on the virtual straight line.

With the present embodiment, the number of rows of holes provided along the rotational direction of the agent carrier is an even number, and the center position in the direction perpendicular to the direction of the rows of holes is positioned closest to the recording member within an acceptable gap range of the printing gap set in advance. Accordingly, as described above, even if the number of rows of toner passage holes is an even number, the printing gaps of the rows of toner passage holes in the same order can be the same, by counting the orders of the rows of toner passage holes located upstream in the rotational direction and downstream in the rotational direction based on the virtual line.

With the present embodiment, the number of rows of holes provided along the rotational direction of the agent carrier is an odd number, a row of holes placed in the center of the rows of holes in the rotational direction is positioned closest to the recording member within an acceptable gap range of the printing gap set in advance, and the angle of the positioning member is adjustably set, by referring to the virtual straight line that passes through the center of the rotation shaft of the agent carrier and the center in the direction perpendicular to the direction of a row of holes placed at the center, and counting orders of rows of holes located upstream in the rotational direction of the agent carrier and downstream in the rotational direction of the agent carrier, so that the printing gaps between the row of holes located upstream in the rotational direction of the agent carrier and the row of holes located downstream in the rotational direction of the agent carrier in the same row order are substantially the same. Accordingly, as described above, even if the number of rows of toner passage holes is an odd number, the printing gaps of the rows of toner passage holes in the same order can be the same, by counting the orders of the rows of toner passage holes located upstream in the rotational direction and downstream in the rotational direction based on the virtual line.

With the present embodiment, the image forming device is provided in plurality in a color image forming apparatus. Accordingly, it is possible to set the print units in the image forming apparatus to desired orientations, thereby further downsizing the image forming apparatus, and improving the attaching and detaching operability of the print unit, for example.

With the present embodiment, by providing the plurality of image forming devices of the present invention, the plurality of image forming devices is all mounted on an apparatus main body of the color image forming apparatus in the same orientation, or each of the image forming devices is mounted in a predetermined orientation. Accordingly, the degree of freedom of layout can be increased.

According to one aspect of the present invention, a predetermined interval can be set and maintained between the agent carrier and the hole defining member. It is also possible to advantageously set and maintain a predetermined printing gap that is an interval between the holes of the hole defining member and the recording member, while preventing the size of image forming apparatus from increasing and reducing cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming device comprising:

a casing that stores therein an image forming agent;

an agent carrier that is rotatably supported by the casing, faces outside of the casing through an opening that is formed on the casing, and carries the image forming agent stored in the casing;

a hole defining member that is formed in a sheet and includes a row of a plurality of holes in an axial direction of the agent carrier, and is arranged opposite to the agent carrier with a predetermined interval therebetween;

a plurality of spray electrodes provided on the hole defining member respectively corresponding to the holes, and forms an electric field for selectively causing the image forming agent to be sprayed from the agent carrier towards the holes; and a positioning member provided on the casing to cover the agent carrier, at least holds the hole defining member in the axial direction of the agent carrier by side walls of its own having a portion defining an opening at a location opposite to the row of holes in the hole defining member, and positions the hole defining member with respect to the agent carrier so that relative positions of the agent carrier and the hole defining member are in a predetermined positional relationship, wherein the image forming device is used in an image forming apparatus that, based on image information, forms an image by depositing the image forming agent selectively caused to be sprayed from the agent carrier by forming a spraying electric field, and having passed through the holes, on a recording member arranged in the image forming apparatus opposite to the agent carrier with the hole defining member interposed therebetween, and wound around and brought into contact with a counter electrode for forming an electric field that attracts the image forming agent caused to be sprayed from the agent carrier, and an angle of the positioning member is adjustable relative to the casing about a rotation shaft that is coaxial with the agent carrier.

2. The image forming device according to claim 1, wherein the positioning member is provided in a detachable manner on the casing in a state in which the positioning member alone or the hole defining member is arranged along the side walls, with the positioning member mounted on the casing, the positioning member is positioned relative to the casing, by engagement of an engaging portion provided on a bearing member attached to a shaft of the agent carrier or to the agent carrier and an engaged portion provided on the positioning member, and the angle of the positioning member is adjustable relative to the casing about the shaft of the agent carrier.

3. The image forming device according to claim 1, wherein the angle of the positioning member is adjustable relative to the casing in a state in which the positioning member alone or the hole defining member is arranged along the side walls.

4. The image forming device according to claim 1, wherein the positioning member is a cover member provided on the casing so as to cover the opening formed on the casing and having a portion defining a second opening at a location opposite to the agent carrier, and holds the hole defining member along outer peripheral surfaces of the side walls that define the second opening of the cover member therein.

5. An image forming apparatus comprising:

an image forming unit that includes a casing that stores therein an image forming agent, an agent carrier that is rotatably supported by the casing, faces outside of the casing through an opening that is formed on the casing, and carries the image forming agent stored in the casing, a hole defining member that is formed in a sheet and includes a row of a plurality of holes in an axial direction of the agent carrier, and is arranged opposite to the agent carrier with a predetermined interval therebetween, a plurality of spray electrodes provided on the hole defining member respectively corresponding to the holes, and forms an electric field for selectively causing the image forming agent to be sprayed from the agent carrier towards the holes, and a positioning member provided on the casing to cover the agent carrier, at least holds the hole defining member in the axial direction of the agent carrier by side walls of its own having a portion defining an opening at a location opposite to the row of holes in the hole defining member, and positions the hole defining member with respect to the agent carrier so that relative positions of the agent carrier and the hole defining member are in a predetermined positional relationship; and a counter electrode that is arranged opposite to the agent carrier with the hole defining member interposed therebetween, and forms an electric field for attracting the image forming agent caused to be sprayed from the agent carrier, wherein based on image information, the image forming apparatus forms an image by deposing the image forming agent selectively caused to be sprayed from the agent carrier by forming a spraying electric field on a recording member, after moving the image forming agent towards the counter electrode through the holes, and an angle of the positioning member is adjustable relative to the casing about a rotation shaft that is coaxial with the agent carrier.

6. The image forming apparatus according to claim 5, wherein when the hole defining member is arranged opposite to the recording member, an interval between the hole defining member and the recording member is set as a predetermined printing gap by adjusting an angle of the positioning member relative to the casing.

7. The image forming apparatus according to claim 6, wherein when the hole defining member is arranged so that the row of holes is placed within an acceptable gap range of the printing gap set in advance, the angle of the positioning member is adjustably set so that a center in a direction perpendicular to a direction of the row of holes is closest to the recording member within the acceptable gap range.

8. The image forming apparatus according to claim 5, wherein the row of holes is provided in plurality in a rotational direction of the agent carrier, and when a predetermined printing gap is formed at a position where the rows of holes are opposed to the recording member, an angle of the positioning member is adjustably set, by referring to a virtual straight line that passes through a center of a rotation shaft of the agent carrier and a center in a direction perpendicular to a direction of the rows of holes, and counting orders of rows of holes located upstream in the rotational direction of the agent carrier and downstream in the rotational direction of the agent carrier, so that printing gaps between the row of holes located upstream in the rotational direction of the agent carrier and the row of holes located downstream in the rotational direction of the agent carrier in a same row order are substantially same.

9. The image forming apparatus according to claim 8, wherein number of rows of holes provided along the rotational direction of the agent carrier is an even number, and a center position in the direction perpendicular to the direction of the rows of holes is positioned closest to the recording member within an acceptable gap range of the printing gap set in advance.

10. The image forming apparatus according to claim 8, wherein number of rows of holes provided along the rotational direction of the agent carrier is an odd number, a row of holes placed in a center of the rows of holes in the rotational direction is positioned closest to the recording member within an acceptable gap range of the printing gap set in advance, and the angle of the positioning member is adjustably set, by referring to the virtual straight line that passes through the center of the rotation shaft of the agent carrier and the center in the direction perpendicular to the direction of a row of holes placed at the center, and counting orders of rows of holes located upstream in the rotational direction of the agent carrier and downstream in the rotational direction of the agent carrier, so that the printing gaps between the row of holes located upstream in the rotational direction of the agent carrier and the row of holes located downstream in the rotational direction of the agent carrier in the same row order are substantially same.

11. The image forming apparatus according to claim 8, wherein the image forming device is provided in plurality.

12. The image forming apparatus according to claim 11, wherein the plurality of image forming devices is all mounted on an apparatus main body in a same orientation, or each of the image forming devices is mounted in a predetermined orientation.

* * * * *

UNITED STATES PATENT AND TRADEMARK OFFICE

CERTIFICATE OF CORRECTION

PATENT NO. : 8,259,141 B2
APPLICATION NO. : 12/650090
DATED : September 4, 2012
INVENTOR(S) : Masanori Saitoh et al.

It is certified that error appears in the above-identified patent and that said Letters Patent is hereby corrected as shown below:

Column 32, line 33, change “image forming devices” to -- image forming units --;
Column 32, line 35, change “image forming devices” to -- image forming units --.

Signed and Sealed this
Thirteenth Day of November, 2012

David J. Kappos

David J. Kappos
*Director of the United States Patent and Trademark Office*